US011100762B2

(12) United States Patent
Fong et al.

(10) Patent No.: US 11,100,762 B2
(45) Date of Patent: Aug. 24, 2021

(54) METHOD OF GAMING, A GAMING SYSTEM AND A GAME CONTROLLER

(71) Applicant: Aristocrat Technologies Australia Pty Limited, North Ryde (AU)

(72) Inventors: Colin Fong, Penshurst (AU); Billy Ho Ching Tam, East Killara (AU); Vinh Hoang Huynh, Ashbury (AU); Gesa Murphy, Marrickville (AU); Christian Salmon, Manly (AU)

(73) Assignee: ARISTOCRAT TECHNOLOGIES AUSTRALIA PTY LIMITED

( * ) Notice: Subject to any disclaimer, the term of this patent is extended or adjusted under 35 U.S.C. 154(b) by 54 days.

(21) Appl. No.: 14/823,743

(22) Filed: Aug. 11, 2015

(65) Prior Publication Data

US 2016/0140795 A1 May 19, 2016

(30) Foreign Application Priority Data

Aug. 11, 2014 (AU) ..... 2014903125

(51) Int. Cl.
*G07F 17/34* (2006.01)
*G07F 17/32* (2006.01)

(52) U.S. Cl.
CPC ..... *G07F 17/34* (2013.01); *G07F 17/3216* (2013.01); *G07F 17/3267* (2013.01)

(58) Field of Classification Search
CPC ..... G07F 17/32; G07F 17/34; G07F 17/3216; G07F 17/3267; A63F 13/10
See application file for complete search history.

(56) References Cited

U.S. PATENT DOCUMENTS 6,089,977 A 7/2000 Bennett
6,254,481 B1 * 7/2001 Jaffe ..... A63F 13/10 273/143 R
7,562,873 B1 * 7/2009 Luciano, Jr. ..... G07F 17/32 273/139
2005/0037836 A1 * 2/2005 Gilmore ..... G07F 17/32 463/25
2007/0232382 A1 10/2007 Berman
(Continued)

OTHER PUBLICATIONS

Australian Examination Report for App. No. AU2019268143 dated Nov. 18, 2020, 4 pages.

*Primary Examiner* — William H McCulloch, Jr.
*Assistant Examiner* — Robert E Mosser
(74) *Attorney, Agent, or Firm* — McAndrews, Held & Malloy, Ltd.

(57) ABSTRACT

An electronic gaming system comprises a first video display, a second video display, and a game controller to select a plurality of symbols from a symbol set for display at respective ones of a plurality of symbol display positions on the first video display. Upon a trigger condition being met, the game controller awards one or more wild symbols to be incorporated into the symbol display independently of selection of the symbols from the symbol set, controls the second video display to display a first portion of a wild symbol awarding animation, and controls the first video display to display a second portion of the wild symbol awarding animation during which one or more animated objects shown in the first portion of the wild symbol awarding animation move to the first video display.

26 Claims, 36 Drawing Sheets

(56) References Cited

U.S. PATENT DOCUMENTS

| | | | | |
|---|---|---|---|---|
| 2008/0176652 | A1* | 7/2008 | Yoshizawa | G07F 17/32 463/31 |
| 2009/0227356 | A1 | 9/2009 | Moroney | |
| 2014/0094255 | A1* | 4/2014 | Schultz | G07F 17/32 463/20 |
| 2015/0302700 | A1* | 10/2015 | Zielinski | G07F 17/3258 463/20 |
| 2016/0140795 | A1 | 5/2016 | Fong | |

* cited by examiner

METHOD OF GAMING, A GAMING SYSTEM AND A GAME CONTROLLER

RELATED APPLICATIONS

This application claims priority to Australian Provisional Patent Application No. 2014903125, having a filing date of Aug. 11, 2014, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In electronic gaming systems such as spinning reel or "slot" gaming machines, symbols are selected for display on a display of the machine. The displayed symbols are evaluated to determine whether an award is to be made to a player.

While such gaming systems provide players with enjoyment, a need exists for alternative gaming systems.

BRIEF SUMMARY OF THE INVENTION

In a first aspect, the invention provides an electronic gaming system comprising:

a first video display;

a second video display; and a game controller arranged to select a plurality of symbols from a symbol set for display at respective ones of a plurality of symbol display positions on the first video display, and upon a trigger condition being met:

award one or more wild symbols to be incorporated into the symbol display independently of selection of the symbols from the symbol set;

control the second video display to display a first portion of a wild symbol awarding animation; and control the first video display to display a second portion of the wild symbol awarding animation during which one or more animated objects shown in the first portion of the wild symbol awarding animation move to the first video display, and wherein the second portion of the wild symbol awarding animation results in the symbol display incorporating the one or more wild symbols, the game controller further arranged to evaluate the symbol display to determine whether to make an award, and to make any determined award.

In an embodiment, the second video display is positioned above the first video display.

In an embodiment, the one or more wild symbols replace symbols initially selected for display in the symbol display.

In an embodiment, during the second portion of the wild symbol awarding animation, the animated objects move to respective ones of the symbol display positions at which a wild symbol will be added.

In an embodiment, a number of the one or more animated objects displayed in the first portion of the wild symbol awarding animation indicates a minimum number wild symbols that will be incorporated into the symbol display.

In an embodiment, the one or more wilds may include a multiple wild symbol, and upon a multiple wild symbol being included in the one or more wild symbols, the multiple wild symbol is first added to a first symbol display position of the symbol display positions, and is then divided into a plurality of single wild symbols, with one of the plurality of single wild symbols remaining at the first symbol display position, and the at least one other single wild symbol being added to another symbol display position.

In an embodiment, the multiple wild symbol is associated with an animated object that is visually distinct from animated objects associated with single wild symbols.

In an embodiment, the game controller is arranged to conduct a random trial having a range of possible outcomes, and the trigger condition is that the outcome of the random trial corresponds to a defined sub-range of the range of possible outcomes.

In a second aspect, the invention provides an electronic game controller, the game controller arranged to:

select a plurality of symbols from a symbol set for display at respective ones of a plurality of symbol display positions on a first video display, and upon a trigger condition being met:

award one or more wild symbols to be incorporated into the symbol display independently of selection of the symbols from the symbol set;

control a second video display to display a first portion of a wild symbol awarding animation; and control the first video display to display a second portion of the wild symbol awarding animation during which one or more animated objects shown in the first portion of the wild symbol awarding animation move to the first video display, and wherein the second portion of the wild symbol awarding animation results in the symbol display incorporating the one or more wild symbols, the game controller further arranged to evaluate the symbol display to determine whether to make an award, and to make any determined award.

In a third aspect, the invention provides an electronic gaming system comprising:

a first video display;

a second video display; and a symbol selector arranged to select a plurality of symbols from a symbol set for display at respective ones of a plurality of symbol display positions on the first video display;

a wild symbol awarder arranged to award one or more wild symbols to be incorporated into the symbol display independently of selection of the symbols from the symbol set;

an animation controller arranged to control the second video display to display a first portion of a wild symbol awarding animation, and control the first video display to display a second portion of the wild symbol awarding animation during which one or more animated objects shown in the first portion of the wild symbol awarding animation move to the first video display, wherein the second portion of the wild symbol awarding animation results in the symbol display incorporating the one or more wild symbols; and an outcome evaluator arranged to evaluate the symbol display to determine whether to make an award, and to make any determined award.

In a fourth aspect, the invention provides an electronic method of gaming, comprising a game controller:

selecting a plurality of symbols from a symbol set for display at respective ones of a plurality of symbol display positions on a first video display, and upon a trigger condition being met:

awarding one or more wild symbols to be incorporated into the symbol display independently of selection of the symbols from the symbol set;

controlling a second video display to display a first portion of a wild symbol awarding animation;

controlling the first video display to display a second portion of the wild symbol awarding animation during which one or more animated objects shown in the first portion of the wild symbol awarding animation move to the first video display, and wherein the second portion of the wild symbol awarding animation results in the symbol display incorporating the one or more wild symbols;

evaluating the symbol display to determine whether to make an award; and making any determined award.

In a fifth aspect, the invention provides an electronic gaming system comprising:

first video display means;

second video display means;

means for selecting a plurality of symbols from a symbol set for display at respective ones of a plurality of symbol display positions on the first video display means, and upon a trigger condition being met:

means for awarding one or more wild symbols to be incorporated into the symbol display independently of selection of the symbols from the symbol set;

means for controlling the second video display means to display a first portion of a wild symbol awarding animation;

means for controlling the first video display means to display a second portion of the wild symbol awarding animation during which one or more animated objects shown in the first portion of the wild symbol awarding animation move to the first video display means, and wherein the second portion of the wild symbol awarding animation results in the symbol display incorporating the one or more wild symbols;

means for evaluating the symbol display to determine whether to make an award; and means for means for making any determined award.

In a sixth aspect, the invention provides computer program code which when executed by a processor causes the processor to:

select a plurality of symbols from a symbol set for display at respective ones of a plurality of symbol display positions on a first video display, and upon a trigger condition being met:

award one or more wild symbols to be incorporated into the symbol display independently of selection of the symbols from the symbol set;

control a second video display to display a first portion of a wild symbol awarding animation;

control the first video display to display a second portion of the wild symbol awarding animation during which one or more animated objects shown in the first portion of the wild symbol awarding animation move to the first video display, and wherein the second portion of the wild symbol awarding animation results in the symbol display incorporating the one or more wild symbols;

evaluate the symbol display to determine whether to make an award; and make any determined award.

In a seventh aspect, the invention provides an electronic gaming system comprising:

at least one video display; and a game controller arranged to select a plurality of symbols from a symbol set for display at respective ones of a plurality of symbol display positions on the at least one video display, and upon a trigger condition being met:

award one or more wild symbols to be incorporated into the symbol display wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position, the game controller further arranged to evaluate the symbol display as modified by the wild symbols to determine whether to make an award, and to make any determined award.

In an embodiment, each randomly selected symbol display position is randomly selected from among symbol display positions not occupied by a wild symbol.

In an eighth aspect, the invention provides an electronic game controller for an electronic gaming system, the game controller arranged to select a plurality of symbols from a symbol set for display at respective ones of a plurality of symbol display positions on the at least one video display, and upon a trigger condition being met:

award one or more wild symbols to be incorporated into the symbol display wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position, the game controller further arranged to evaluate the symbol display as modified by the wild symbols to determine whether to make an award, and to make any determined award.

In a ninth aspect, the invention provides an electronic gaming system comprising:

at least one video display; and a symbol selector arranged to select a plurality of symbols from a symbol set for display at respective ones of a plurality of symbol display positions on the at least one video display;

a wild symbol awarder arranged to award one or more wild symbols to be incorporated into the symbol display upon a trigger condition being met wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position; and an outcome evaluator arranged to evaluate the symbol display as modified by the wild symbols to determine whether to make an award, and to make any determined award.

In a tenth aspect, the invention provides an electronic gaming system comprising:

at least one video display means; and means for selecting a plurality of symbols from a symbol set for display at respective ones of a plurality of symbol display positions on the at least one video display;

means for awarding one or more wild symbols to be incorporated into the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position;

means for evaluating the symbol display as modified by the wild symbols to determine whether to make an award; and means for making any determined award.

In an eleventh aspect, the invention provides an electronic method of gaming, comprising a game controller:

selecting a plurality of symbols from a symbol set for display at respective ones of a plurality of symbol display positions on the at least one video display;

awarding one or more wild symbols to be incorporated into the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position;

evaluating the symbol display as modified by the wild symbols to determine whether to make an award; and making any determined award.

In a twelfth aspect, the invention provides an omputer program code which when executed by a processor causes the processor to:

select a plurality of symbols from a symbol set for display at respective ones of a plurality of symbol display positions on the at least one video display;

award one or more wild symbols to be incorporated into the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position;

evaluate the symbol display as modified by the wild symbols to determine whether to make an award; and make any determined award.

In a thirteenth aspect, the invention provides an electronic method of gaming comprising an electronic game controller:

generating a game outcome by selecting symbols from a symbol set for display in respective ones of a plurality of symbol display positions, wherein the symbol set comprises a plurality of trigger symbols, at least one of which is associated with a multiplier;

evaluating the game outcome to determine whether the symbols displayed at the symbol display positions include a designated number of trigger symbols;

awarding a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier; and conducting the awarded game rounds.

In an embodiment, the symbol display comprises a plurality of columns, each comprising a plurality of symbol display positions and the symbol set comprises a plurality of subsets corresponding to respective ones of the plurality of columns, and wherein the game controller selects symbols for the symbol display by independently selecting a plurality symbols from each of the subsets.

In an embodiment, each subset is a reel of symbols.

In a fourteenth aspect, the invention provides an electronic gaming system comprising:

a symbol selector selecting symbols from a symbol set for display in respective ones of a plurality of symbol display positions, wherein the symbol set comprises a plurality of trigger symbols, at least one of which is associated with a multiplier;

trigger monitor arranged to evaluate the game outcome to determine whether the symbols displayed at the symbol display positions include a designated number of trigger symbols; and a game round awarder arranged to award a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier, whereafter the gaming system conducts the awarded game rounds.

In a fifteenth aspect, the invention provides an electronic game controller arranged to:

generate a game outcome by selecting symbols from a symbol set for display in respective ones of a plurality of symbol display positions, wherein the symbol set comprises a plurality of trigger symbols, at least one of which is associated with a multiplier;

evaluate the game outcome to determine whether the symbols displayed at the symbol display positions include a designated number of trigger symbols;

award a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier; and conduct the awarded game rounds.

In a sixteenth aspect, the invention provides an electronic gaming system comprising:

means for generating a game outcome by selecting symbols from a symbol set for display in respective ones of a plurality of symbol display positions, wherein the symbol set comprises a plurality of trigger symbols, at least one of which is associated with a multiplier;

means for evaluating the game outcome to determine whether the symbols displayed at the symbol display positions include a designated number of trigger symbols;

means for awarding a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier; and means for conducting the awarded game rounds.

In a seventeenth aspect, the invention provides an omputer program code which when executed by a processor causes the processor to:

select a plurality of symbols from a symbol set for display at respective ones of a plurality of symbol display positions on the at least one video display;

award one or more wild symbols to be added to the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position;

evaluate the symbol display as modified by the wild symbols to determine whether to make an award; and make any determined award.

The invention also provides a tangible computer readable medium comprising the above computer program code.

The invention also provides an electronic gaming system comprising: first video display means; second video display means; means for selecting a plurality of symbols from a symbol set for display at respective ones of a plurality of symbol display positions on the first video display means, and upon a trigger condition being met: means for awarding one or more wild symbols to be incorporated into the symbol display independently of selection of the symbols from the symbol set; means for controlling the second video display means to display a first portion of a wild symbol awarding animation; means for controlling the first video display means to display a second portion of the wild symbol awarding animation during which one or more animated objects shown in the first portion of the wild symbol awarding animation move to the first video display means, and wherein the second portion of the wild symbol awarding animation results in the symbol display incorporating the one or more wild symbols; means for evaluating the symbol display to determine whether to make an award; and means for means for making any determined award.

The invention also provides an electronic gaming system having computer program code which when executed by a processor causes the processor to: select a plurality of symbols from a symbol set for display at respective ones of a plurality of symbol display positions on a first video display, and upon a trigger condition being met: award one or more wild symbols to be incorporated into the symbol display independently of selection of the symbols from the symbol set; control a second video display to display a first portion of a wild symbol awarding animation; control the first video display to display a second portion of the wild symbol awarding animation during which one or more animated objects shown in the first portion of the wild symbol awarding animation move to the first video display, and wherein the second portion of the wild symbol awarding animation results in the symbol display incorporating the one or more wild symbols; evaluate the symbol display to determine whether to make an award; and make any determined award.

The electronic gaming system further comprises a tangible computer readable medium configured to store the computer program code.

The invention also provides an electronic gaming system comprising: at least one video display; and a game controller arranged to select a plurality of symbols from a symbol set for display at respective ones of a plurality of symbol display positions on the at least one video display, and upon a trigger condition being met: award one or more wild symbols to be incorporated into the symbol display wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position, the game controller further arranged to evaluate the symbol display as modified by the wild symbols to determine whether to make an award, and to make any determined award.

The invention also provides an electronic gaming system as discussed above, wherein each randomly selected symbol display position is randomly selected from among symbol display positions not occupied by a wild symbol.

The invention also provides an electronic game controller for an electronic gaming system, the game controller arranged to select a plurality of symbols from a symbol set for display at respective ones of a plurality of symbol display positions on the at least one video display, and upon a trigger condition being met: award one or more wild symbols to be incorporated into the symbol display wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position, the game controller further arranged to evaluate the symbol display as modified by the wild symbols to determine whether to make an award, and to make any determined award.

The invention also provides an electronic game controller as discussed above, wherein each randomly selected symbol display position is randomly selected by the game controller from among symbol display positions not occupied by a wild symbol.

The invention also provides an electronic gaming system comprising: at least one video display; and a symbol selector arranged to select a plurality of symbols from a symbol set for display at respective ones of a plurality of symbol display positions on the at least one video display; a wild symbol awarder arranged to award one or more wild symbols to be incorporated into the symbol display upon a trigger condition being met wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position; and an outcome evaluator arranged to evaluate the symbol display as modified by the wild symbols to determine whether to make an award, and to make any determined award.

The invention also provides an electronic gaming system comprising: at least one video display means; and means for selecting a plurality of symbols from a symbol set for display at respective ones of a plurality of symbol display positions on the at least one video display; means for awarding one or more wild symbols to be incorporated into the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position; means for evaluating the symbol display as modified by the wild symbols to determine whether to make an award; and means for making any determined award.

The invention also provides an electronic method of gaming, comprising a game controller: selecting a plurality of symbols from a symbol set for display at respective ones of a plurality of symbol display positions on the at least one video display; awarding one or more wild symbols to be incorporated into the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position; evaluating the symbol display as modified by the wild symbols to determine whether to make an award; and making any determined award.

The invention also provides an electronic method of gaming as discussed above, wherein each randomly selected symbol display position is randomly selected by the game controller from among symbol display positions not occupied by a wild symbol.

The invention also provides an electronic gaming system having computer program code which when executed by a processor causes the processor to: select a plurality of symbols from a symbol set for display at respective ones of a plurality of symbol display positions on the at least one video display; award one or more wild symbols to be incorporated into the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position; evaluate the symbol display as modified by the wild symbols to determine whether to make an award; and make any determined award.

The invention also provides an electronic gaming system as discussed above, and further provides a tangible computer readable medium configured to store the computer program code.

The invention also provides an electronic method of gaming comprising an electronic game controller: generating a game outcome by selecting symbols from a symbol set for display in respective ones of a plurality of symbol display positions, wherein the symbol set comprises a plurality of trigger symbols, at least one of which is associated with a multiplier; evaluating the game outcome to determine whether the symbols displayed at the symbol display positions include a designated number of trigger symbols; awarding a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier; and conducting the awarded game rounds.

The symbol display comprises a plurality of columns, each comprising a plurality of symbol display positions and the symbol set comprises a plurality of subsets corresponding to respective ones of the plurality of columns, and wherein the game controller selects symbols for the symbol display by independently selecting a plurality symbols from each of the subsets.

The invention also provides an electronic gaming system as discussed above, wherein each subset is a reel of symbols.

The invention also provides an electronic gaming system comprising: a symbol selector selecting symbols from a symbol set for display in respective ones of a plurality of symbol display positions, wherein the symbol set comprises a plurality of trigger symbols, at least one of which is associated with a multiplier; trigger monitor arranged to evaluate the game outcome to determine whether the symbols displayed at the symbol display positions include a designated number of trigger symbols; and a game round awarder arranged to award a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier, whereafter the gaming system conducts the awarded game rounds.

The invention also provides an electronic gaming system as discussed above, wherein the symbol display comprises a plurality of columns, each comprising a plurality of symbol display positions and the symbol set comprises a plurality of subsets corresponding to respective ones of the plurality of columns, and wherein the symbol selector selects symbols for the symbol display by independently selecting a plurality symbols from each of the subsets.

The invention also provides an electronic gaming system as discussed above, wherein each subset is a reel of symbols.

The invention also provides an electronic game controller arranged to: generate a game outcome by selecting symbols from a symbol set for display in respective ones of a plurality of symbol display positions, wherein the symbol set comprises a plurality of trigger symbols, at least one of which is associated with a multiplier; evaluate the game outcome to determine whether the symbols displayed at the symbol display positions include a designated number of trigger symbols; award a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier; and conduct the awarded game rounds.

The invention also provides a game controller as discussed above, wherein the symbol display comprises a plurality of columns, each comprising a plurality of symbol display positions and the symbol set comprises a plurality of subsets corresponding to respective ones of the plurality of columns, and wherein the game controller selects symbols for the symbol display by independently selecting a plurality symbols from each of the subsets.

The invention also provides a game controller as discussed above, wherein each subset is a reel of symbols.

The invention also provides an electronic gaming system comprising: means for generating a game outcome by selecting symbols from a symbol set for display in respective ones of a plurality of symbol display positions, wherein the symbol set comprises a plurality of trigger symbols, at least one of which is associated with a multiplier; means for evaluating the game outcome to determine whether the symbols displayed at the symbol display positions include a designated number of trigger symbols; means for awarding a number of game rounds upon the selected symbols displayed at the symbol display positions including a designated number of trigger symbols, wherein, for the same designated number of trigger symbols, upon none of the trigger symbols being associated with a multiplier, the number of game rounds awarded is a first number, and upon one of the trigger symbols being associated with the multiplier, the number of game rounds awarded is a second number corresponding to the first number multiplied by the multiplier; and means for conducting the awarded game rounds.

The invention also provides an electronic gaming system having computer program code which when executed by a processor causes the processor to: select a plurality of symbols from a symbol set for display at respective ones of a plurality of symbol display positions on the at least one video display; award one or more wild symbols to be added to the symbol display upon a trigger condition being met, wherein the one or more wilds may include a single wild symbol and a multiple wild symbol, and wherein each single wild symbol is added to a randomly selected one of the symbol display positions, and upon a multiple wild symbol being included in the one or more wild symbols, the multiple wild symbol is first added to a randomly selected first symbol display position of the symbol display positions, and is then divided into a plurality of single wild symbols, with one of the plurality of single wild symbols remaining at the first symbol display position, and the at least one other single wild symbol being added to another randomly selected symbol display position; evaluate the symbol display as modified by the wild symbols to determine whether to make an award; and make any determined award.

The invention also provides an electronic gaming system as discussed above, further comprises a tangible computer readable medium configured to store the computer program code.

The invention also provides an electronic gaming system comprising: a first video display; a second video display;

a symbol selector arranged to select a plurality of symbols from a symbol set for display at respective ones of a plurality of symbol display positions on the first video display;

a wild symbol awarder arranged to award one or more wild symbols to be incorporated into the symbol display independently of selection of the symbols from the symbol set;

an animation controller arranged to control the second video display to display a first portion of a wild symbol awarding animation, and control the first video display to display a second portion of the wild symbol awarding animation during which one or more animated objects shown in the first portion of the wild symbol awarding animation move to the first video display, wherein the second portion of the wild symbol awarding animation results in the symbol display incorporating the one or more wild symbols; and an outcome evaluator arranged to evaluate the symbol display to determine whether to make an award, and to make any determined award.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
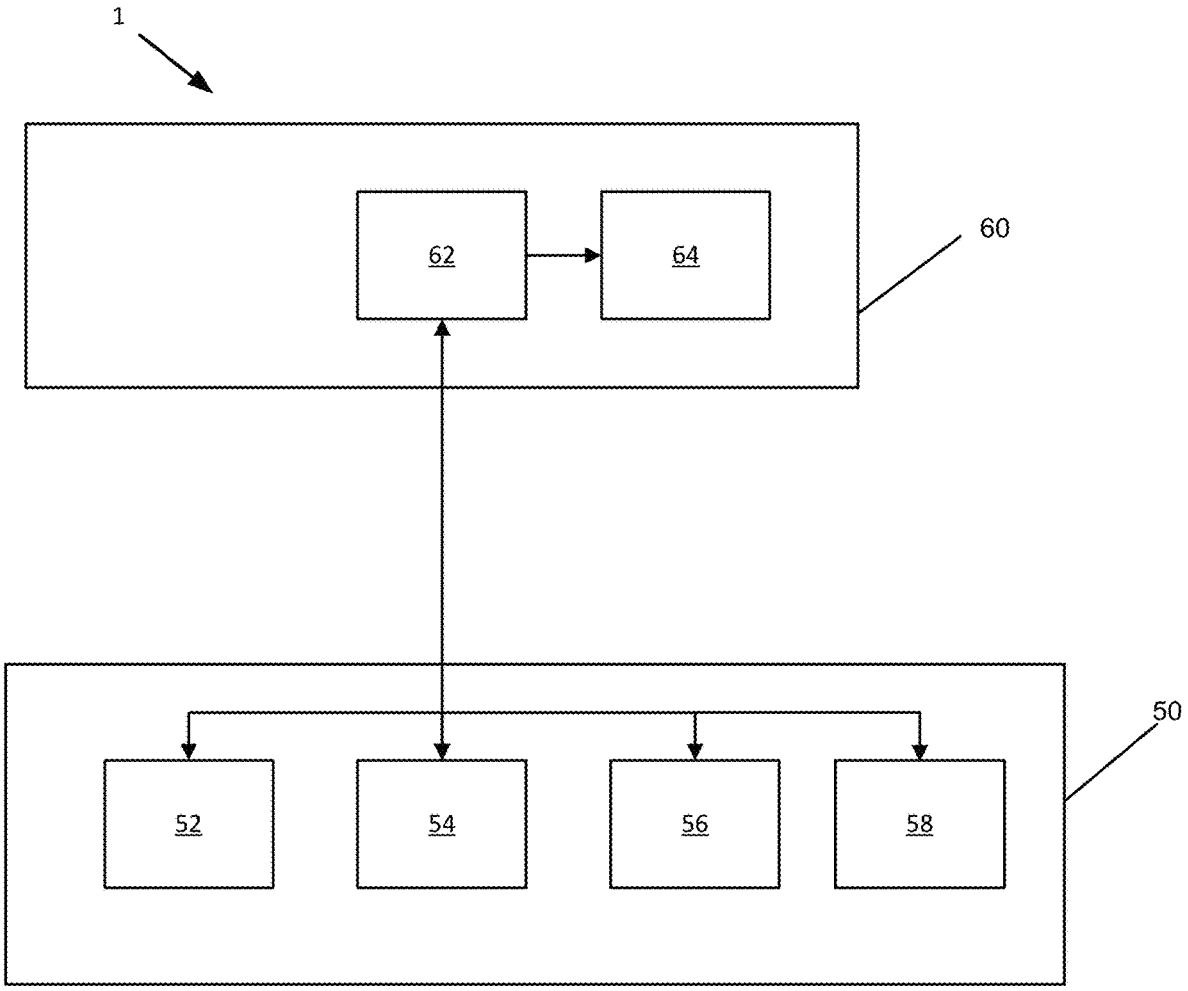
FIG. 1 is a block diagram of the core components of a gaming system.

Referring to the drawings, there is shown an embodiment of an electronic gaming system wherein a plurality of wild symbols are awarded by a game controller upon a trigger condition being met and are added to the selected symbols of a symbol display by the game controller to form a modified symbol display which is evaluated in order to determine whether to make an award. In an embodiment, the gaming system has components that enable a wild symbol awarding animation to accompany the awarding of the wild symbols. In an embodiment, the game controller displays selected symbols as a symbol display on a first video display and displays a first part of a wild symbol awarding animation on a second display located above the first video display. The game controller controls the movement of animated objects from the second video display to the first video display in order to add the wild symbols to the symbol display. In some embodiments, the wild symbols may include multiple wild symbols which the game controller changes into a plurality of single wild symbols after reaching a symbol display position in the symbol display. The game controller has components configures such that one of the single wild symbols stays at the symbol display position while the other one or more single wild symbols are added to other symbol display positions.

In an embodiment, the gaming system may award of a plurality of game rounds such as a number of free spins. The symbols that trigger the awarding of the game rounds may include a multiplier symbol. The game controller controls the awarding of game rounds such that the number of game rounds awarded is multiplied by the multiplier.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
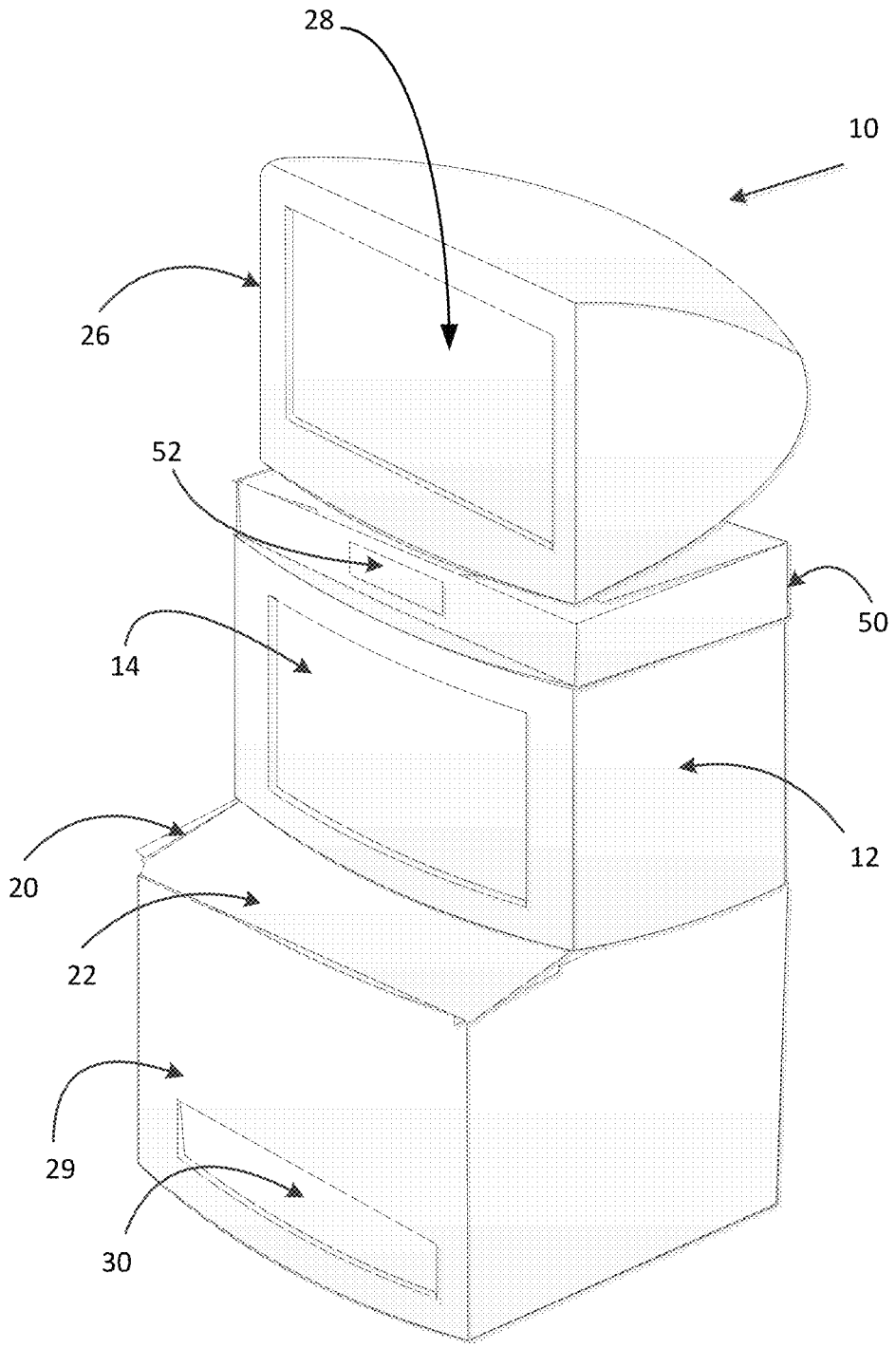
FIG. 2 is a perspective view of a standalone gaming machine.

A gaming system in the form of a standalone gaming machine 10 is illustrated in FIG. 2. The gaming machine 10 includes a console 12 having a first video display 14. A mid-trim 20 of the gaming machine 10 houses a bank of buttons 22 for enabling a player to interact with the gaming machine, in particular during game play. The video display 14 may also have a touch screen to enable the user to input instructions. The video display 14 shown in FIG. 2 is in the form of a video display unit, particularly a cathode ray tube device. Alternatively, the display 14 may be a liquid crystal display, plasma screen, any other suitable video display unit. The top box 26 has a secondary video which may be of the same type as the display 14, or of a different type.

While not shown in FIG. 2, the mid-trim 20 also typically houses a credit input mechanism such as a coin input chute and a bill collector. FIG. 2 also shows the another credit input mechanism in the form of a player marketing module 50 having a reading device 52 for the purpose of reading a player tracking device, for example as part of a loyalty program. The player tracking device may be in the form of a card, flash drive or any other portable storage medium capable of being read by the reading device. The player marketing module 50 also allows the player to transferring credits to the gaming machine from credits stored on the player tracking device or by transferring credits from a player account in data communication with the player marketing module. Other embodiments of gaming machines may have a ticket reader for reading tickets having a value and crediting the player based on the face value of the ticker.

Artwork and/or information may be provided on a front panel 29 of the console 12. A coin tray 30 is mounted beneath the front panel 29 for dispensing cash payouts from the gaming machine 10.

Figure 3:
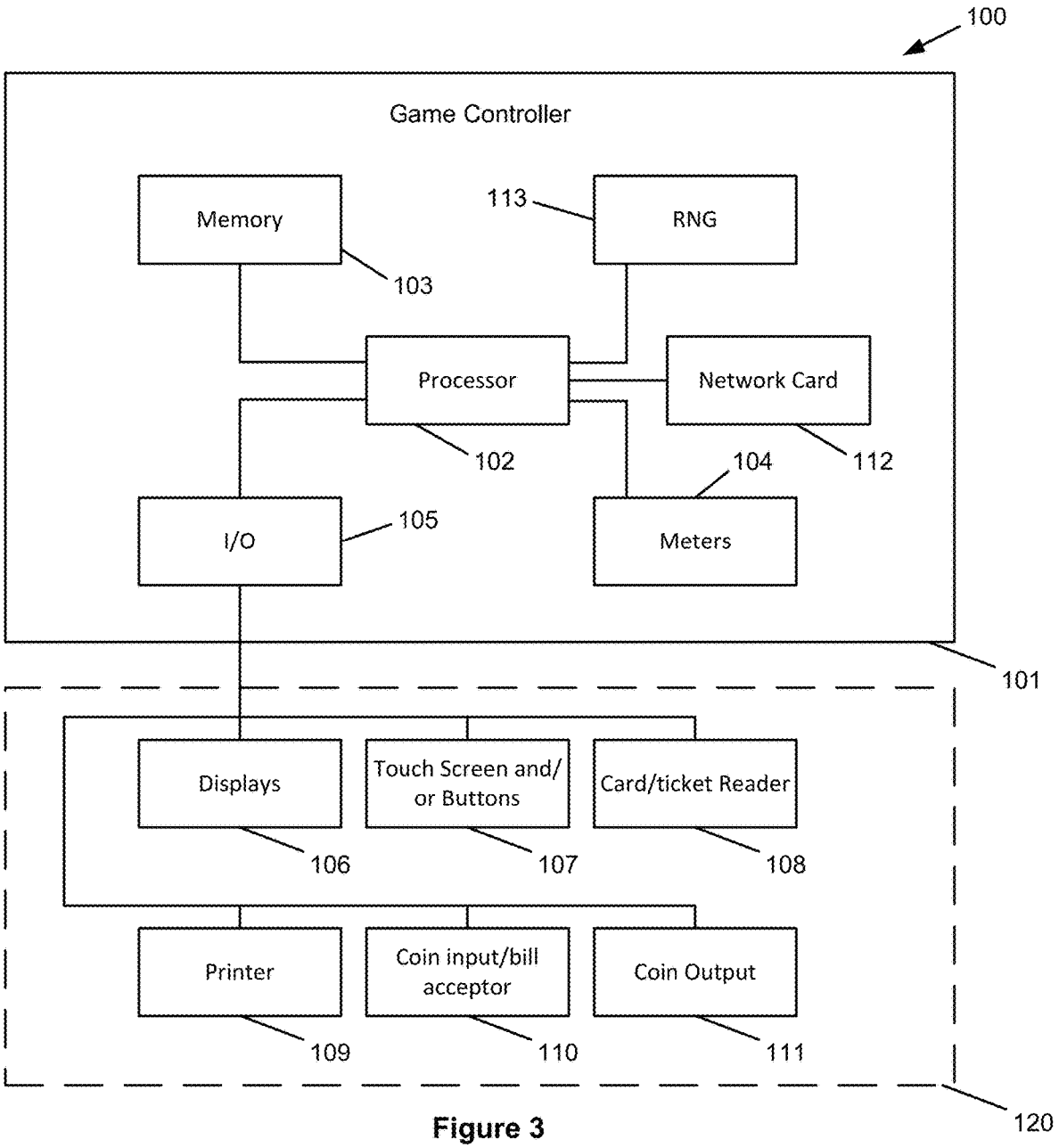
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
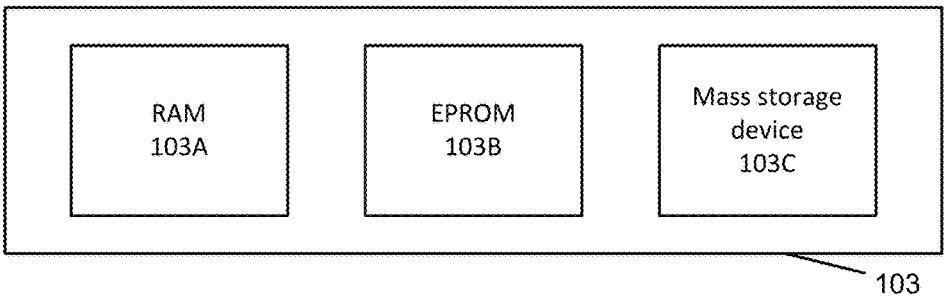
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
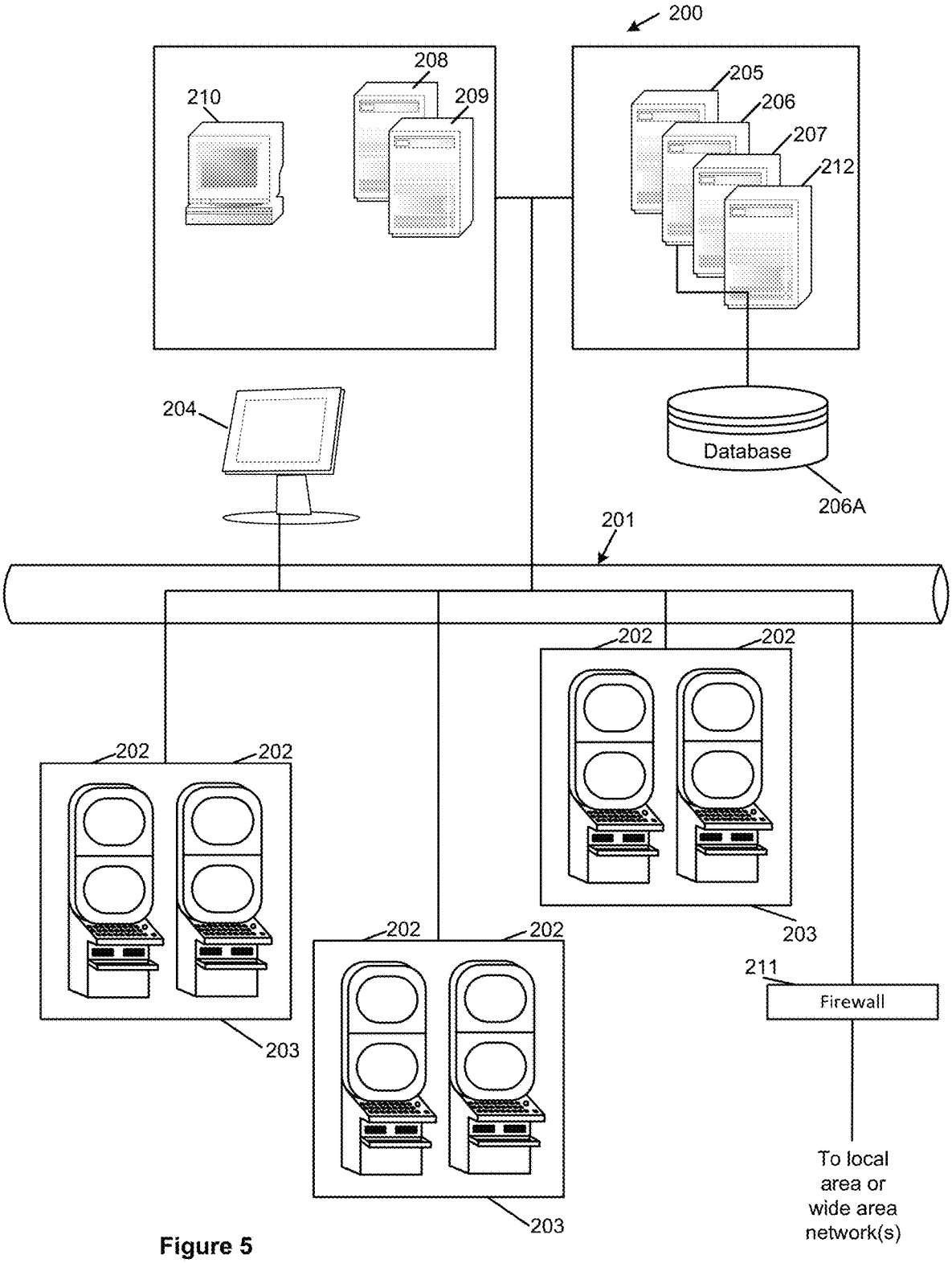
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

Figure 6:
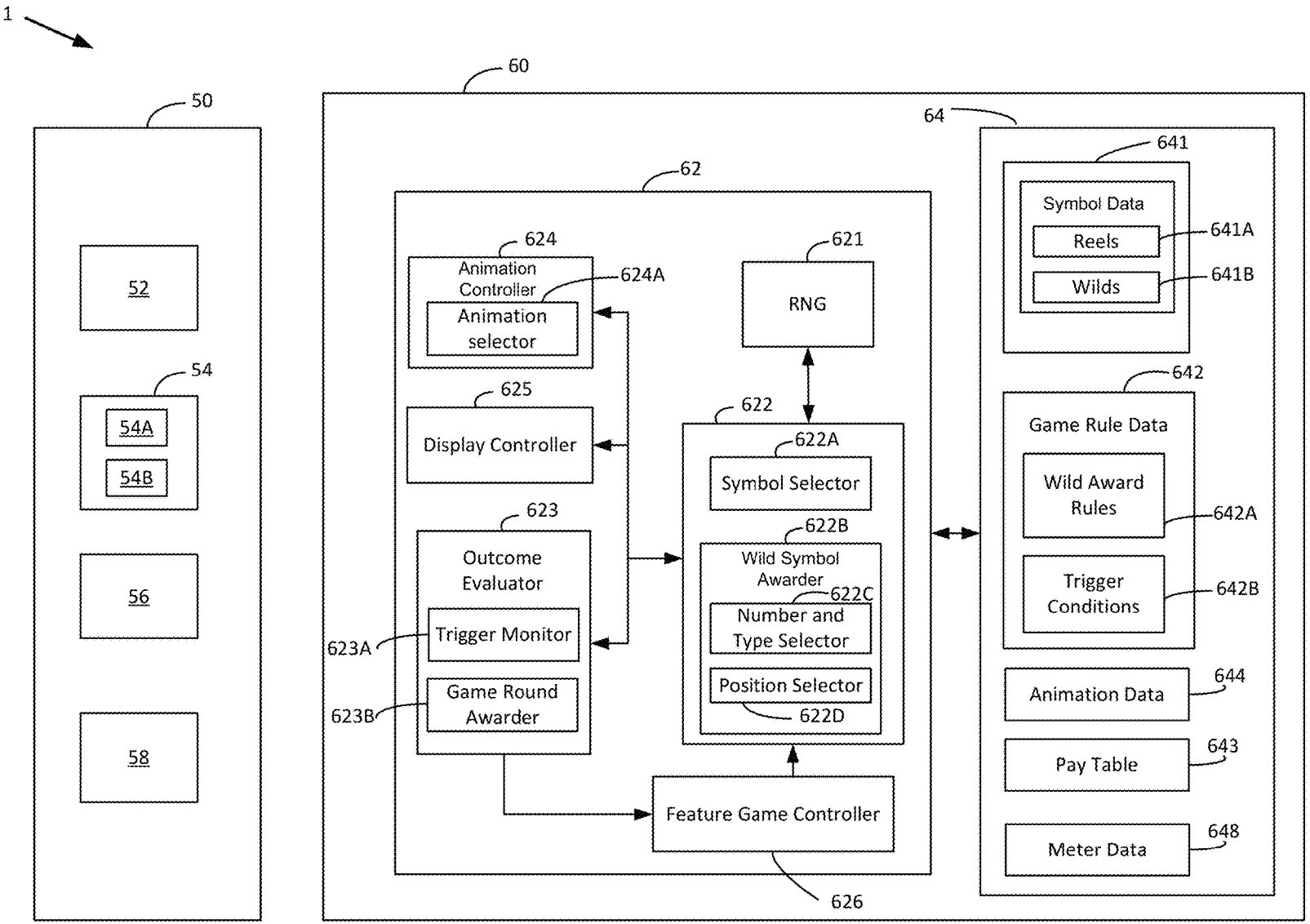
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by outcome evaluator 623. The first part of forming the game outcome is for a symbol selector 622A to select symbols from a set of symbols specified by symbol data 641 using random number generator 621 that are to make up a symbol display. If no wild symbols are to be awarded by the independent wild awarding process described below, the selected symbols are advised to the display controller 625 which causes them to be displayed as a symbol display on display 54 at a set of display positions. If wild symbols are to be incorporated into the final symbol display, in some embodiments this may be implemented by the game controller while the reels are spinning. In other embodiments, this may be implemented by the game controller as the reels reach their stop positions. In other embodiments, this may be implemented by the game controller after the reels have been stopped and the initially selected symbols have been displayed. In some embodiments, some wilds may be added by the game controller at different times. For example, single wilds and multi-wild symbols may be added by the game controller as the reels are spinning while the single wilds stemming from the multi-wilds may be added by the game controller after the reels have been stopped.

In the embodiment described below, the display positions of the symbol display are arranged in a rectangular matrix comprising a plurality of columns and a plurality of rows. However, in other arrangements are known in the gaming industry and could be employed in embodiments of the invention. For example, in some arrangements there are more symbols in some columns than other, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighbouring reel.

In one embodiment, the outcome generator 622 is arranged to generate one or more game outcomes. All outcomes are displayed on first video display 54A under control of display controller 625. One example of generating a first game outcome is for the symbol selector 622A to select symbols for display from symbol data 641 in the form of a plurality of symbol sets corresponding to respective ones of a plurality of reels. The symbol sets specify a sequence of symbols for each reel such that the symbol selector 622A can select all of the symbols to be displayed for each reel 641A by selecting a stopping position in the sequence randomly based on a result obtained from random number generator 621. In one example, three symbols of each of five reels may be displayed such that symbols are displayed at a symbol display fifteen display positions on display 54A. It is known to use a probability table stored in memory 64 to vary the odds of a particular stop position being selected. Other techniques can be used to control the odds of particular outcomes (e.g., winning symbol combinations) occurring to thereby control the return to player of the game.

In the embodiment, in each game, a wild symbol awarder 622B randomly and independently of the action of symbol selector 622A determines whether or not to incorporate one or more wild symbols (symbols that substitute for other symbols in winning symbol combinations) into the symbol display. As a result, and as will be explained in further detail below, the game outcome will hence either be a symbol display based on the symbols as originally selected or a modified symbol display based on the incorporation of the one or more wild symbols into the originally selected symbols. In the embodiment, the positions at which the wild symbols are incorporated into the symbol display are also selected randomly under control of wild symbol awarder 622B. Once the symbol display is finalised, it is evaluated by the outcome evaluator 623 to determine whether they include any winning combinations in pay table 643 to determine whether to make an award. Any award is added to the win meter maintained in memory 64 as part of meter data 648. The meter data 648 also includes the current value of a credit meter. The current values of the credit and win meters are displayed on display 54A by the display controller 625. Wins are transferred from the win meter to the credit meter at the end of a play of the game. Wagers are deducted from the credit meter when play of a game commences.

As indicated above, in embodiments of the invention, the wild symbol awarder 622A randomly determines each time the reels are spun whether to add one or more wild symbols to the symbol display. Therefore, in each play of the base game, there is a random determination by the wild symbol awarder 622A using a value obtained from random number generator 621 to determine whether to add one or more wild symbols. Further, if a feature game is awarded involving a number of free games, a random determination is conducted in respect of each of the free games to determine whether to add extra wild symbols to the game outcome displayed in the symbol display. In this respect it will be appreciated that the game controller 62 conducts the game based on game rule data includes wild award rule data 642A, which includes a table in which possible values that can be returned from the random number generator 621 are assigned into a range for which wild symbols will be awarded and a range for which no wild symbols are awarded. Accordingly, it will be appreciated that the random number generator 621 producing a value within the range assigned to wild symbols being awarded is a trigger condition which leads to the adding of the one or more wild symbols.

In the embodiment, the wild symbol awarder 622B, separately determines the number and type of wild symbols to be awarded with number and type selector 622C using a further random process. It will be appreciated that in some embodiments, the wild symbol awarder could select the number of wild symbols to be awarded in a single step by breaking up the range of random number generator values assigned to the awarding of wild symbols into a number of sub-ranges associated with different numbers of wild symbols being awarded. This may also include assigning different ranges to different types of symbols. For example, as will be described in further detail below, the types of wild symbols that can be awarded include single wild symbols and multi-wild symbols. The types of wild symbols are stored as wild symbol data 641B in symbol data 641.

In one embodiment separate ranges are allocated to the same number of wild symbols but with a different composition of single wild and multi-wild symbols.

Further, while in the embodiment, the number and type of wild symbols that are added are randomly determined, in some embodiments, the type of wild symbols could be set and depend on the number of symbols selected.

As also shown in FIG. 6, the wild symbol awarder 622B also randomly selects the positions on the symbol display at which the large symbols will be displayed using position selector 622D which obtains values from the random number generator 621 and maps these to display positions in a similar manner to the manner in which the values of the random number generator are mapped to numbers of wild symbols to be added. As indicated above, once the symbols have been selected they are evaluated by the outcome evaluator 623.

In conjunction with the awarding of the wild symbols, an animation is provided where an animation controller 624 controls the second video display 54B to display a first portion of a wild symbol awarding animation and controls the first video display 54A on which to display a second portion of the wild symbol awarding animation. In the embodiment, the first portion of the wild symbol awarding animation conducted under control of animation controller 624 involves the display of one or more animated objects that correspond to the awarding of the wild symbols and the one or more objects move from the second video display to the first video display to provide the second portion of the wild symbol awarding animation. In the embodiment, the objects move to positions within the symbol display corresponding to symbols where symbol positions where wild symbols will be added to the symbol display. It is preferred that the second video display is positioned above the first video display so that the animated objects move down from the second video display into the first video display. Depending on the embodiment, the wild symbols may replace the symbols initially selected for display at symbol positions of the symbol display or may be displayed in conjunction with the symbols that are displayed at those positions. In some embodiments, some symbols are replaced while other symbols remain when the wild symbols are incorporated into the symbol display. For example, any scatter symbols which trigger the awarding of a feature game may displayed in addition to the wild symbols. In the embodiment, it is preferred that the number of one or more animated objects displayed in the first portion of the wild symbol awarding animation indicates a minimum number of wild symbols that will be added to the symbol display.

As indicated above, the one or more wild symbols may include a multiple wild symbol. In some embodiments, the multiple wild symbols is first added to a first symbol display position of the symbol display positions which has been randomly selected by the position selector 622D and then is divided into a plurality of single wild symbols with one of the single wild symbols remaining at the original symbol position whilst new positions are randomly determined for the others of the single wild symbols. In some embodiments, this position selection occurs only after the original symbol position has been selected. In other embodiments, this position selection occurs at the time that the other positions are selected for wild symbols but is not displayed until after the multiple wild symbol has been displayed at a symbol display position. In an embodiment, the position which is selected by position selector 622D for each wild symbol is randomly selected from among symbol display positions not occupied by wild symbols.

It will be appreciated that in some embodiments, the animated object associated with the multiple wild symbol may be visually distinct from the animated object associated with single wild symbols in order to indicate to the player in advance that a multiple wild symbol is to be awarded.

In this respect, the animation controller 624 includes an animation selector 624A for selecting an animation from animation data 644 based on the number and type of wild symbols to be awarded. In this respect, in some embodiments, the animation used may depend on the number of wild symbols, and once the number of symbols to be awarded crosses a certain threshold, a special animation may be used to display the awarding of the symbols which does not involve wild symbols being animated as individually moving to their display positions.

As indicated above, embodiments of the invention may involve the awarding by the game controller of a number of additional game rounds in the form of a plurality of free games. As known in the art, the awarding of a number of free games is often referred to as a feature game and the rules for the feature game may be the same or different to the rules of the base game. For example, there may be a change in the composition of the reels 641A for the feature game or a change to the pay table 641B or both. In order to allow the feature games to be conducted, the outcome evaluator 623 includes a trigger monitor 623A which determines whether to award a feature game based on whether a trigger condition 624B has been met. In embodiments of the invention, the feature game is awarded when a defined number of scatter symbols are spun up on the display. In this respect, scatter symbols are symbols which do not need to fall on a pay line (or set of reels) selected by the player but rather can appear at any position within the symbol display. In the embodiment, different numbers of free games are awarded depending on the number of scatter symbols appearing on the display when the feature game was triggered. Accordingly, the game round awarder 623B awards the number of free games based on the number of scatter symbols that appear in the display. In embodiments of the invention, the scatter symbols may also be associated with a multiplier. This may be represented, for example, by a different visual appearance of some of the individual scatter symbols. Accordingly, if the scatter symbols that appear on display 54A includes a multiplier, then the number of free games is multiplied by that amount by the game round awarder 623B. For example, 10, 15, and 25 free games are awarded for 3, 4 or 5 scatter respectively, then if a two times multiplier scatter symbol is included in the triggering combination, the number of free games awarded would be 20, 30 and 50 respectively. Once the game rounds are awarded, they conducted under the control of the feature game controller 626 which causes the outcome generator 622 to conduct the series of game rounds by selecting symbols in the manner described above.

In the embodiment, the scatter symbols do not trigger further free games during the feature game. However, in other embodiments additional free games may be awarded if the trigger condition is met in the free game rounds.

Figure 7:
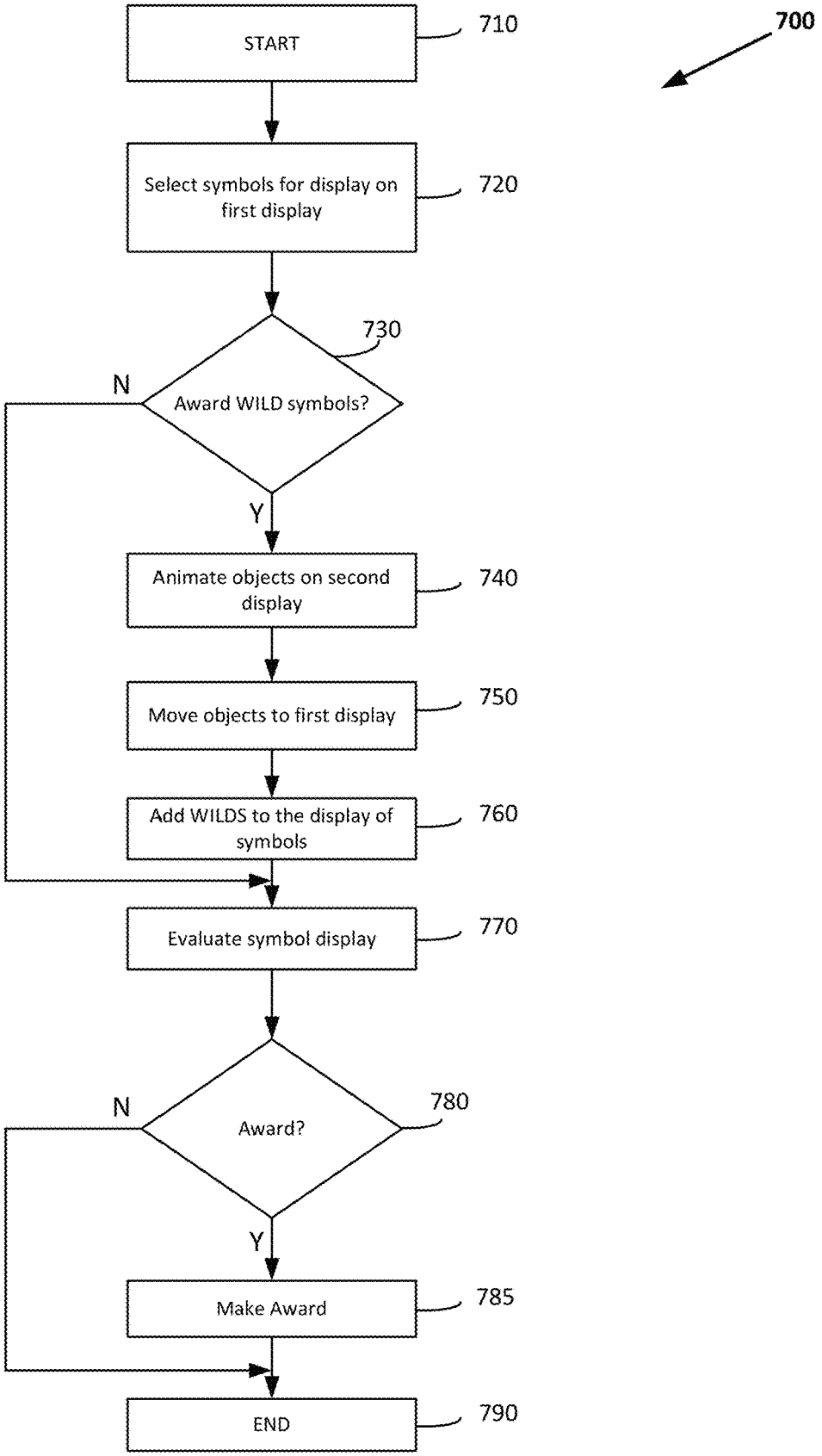
FIG. 7 is a flow chart of an embodiment.

Referring now to FIG. 7, a method 700 of an embodiment is summarised with respect to a flowchart. When the game starts 710, the outcome generator selects 720 symbols for display on the first display. The outcome generator independently determines 730 whether to award wild symbols and if the wild symbols are not awarded then the symbol display will be evaluated 770 to determine whether to make an award 780 after which an award may or may not be made 785 and the game ends 790 (assuming no free games are awarded). Alternatively, if it is determined to award wild symbols at step 730, an animation of animated objects is selected and played 740 on the second display 54B. In this respect, in an embodiment, the animation is displayed while the reels are shown as spinning on the first display such that the animated objects move within the second display area 54B while the reels spin in the first area 54A. In this embodiment, the reels only stop once the animated objects have moved their symbol display positions. In other embodiments, the animation will be displayed after the reels have stopped. The method continues by moving the one or more objects to the first display 750 and adding wilds to the displayed symbols 760. Once the final symbol display is formed, the symbols are evaluated 770 as described above.

Figure 8:
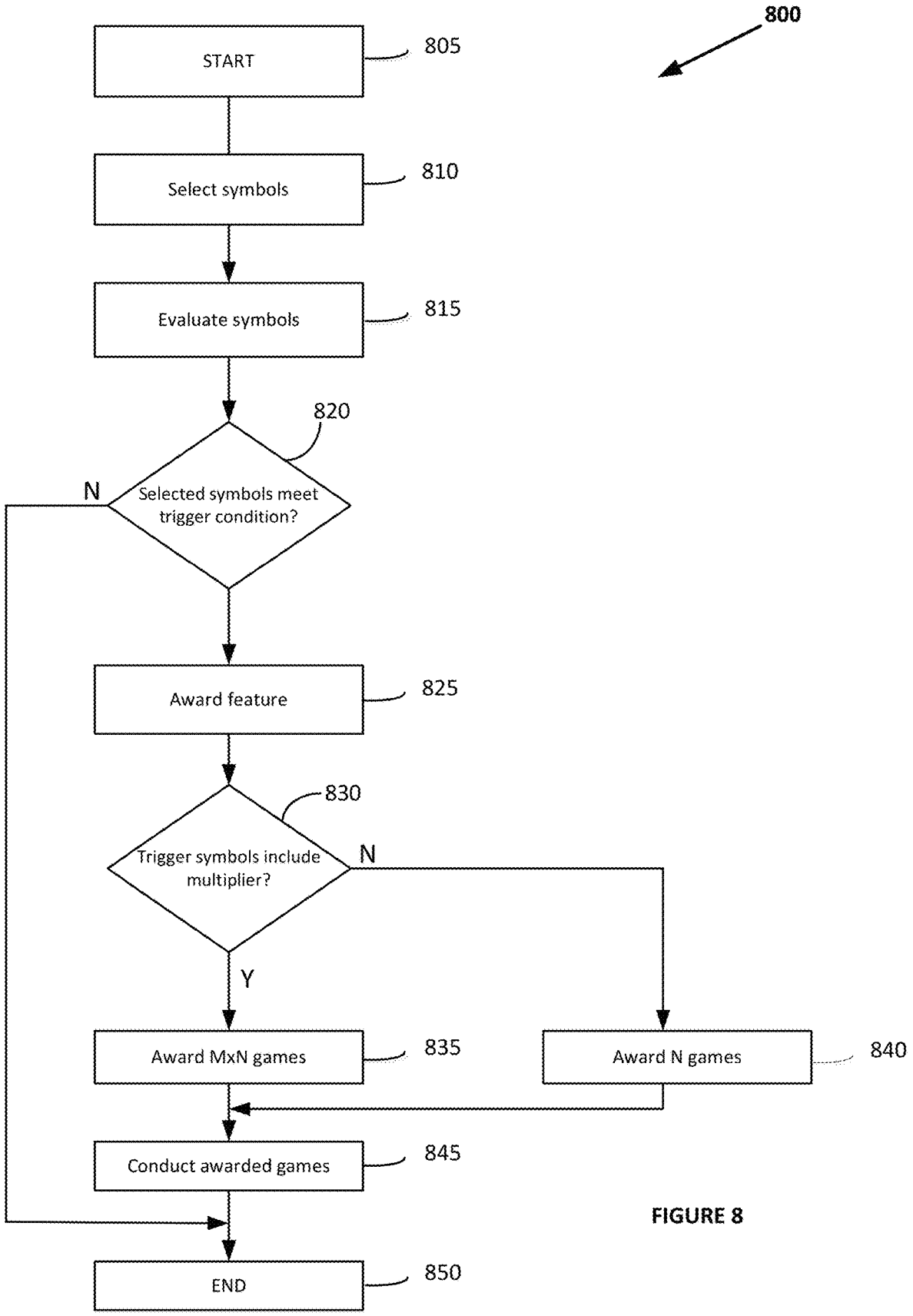
FIG. 8 is a flow chart of another embodiment.

FIG. 8 illustrates the method 800 of awarding a number of feature games. The game starts 805 and involves selecting symbols 810 and an evaluation of the selected symbols 815. It is determined whether the selected symbols meet a trigger condition 820 and if not the game ends whereas if the symbols meet the trigger condition a feature game is awarded 825. It is then determined whether or not the trigger symbols include a multiplier 830, if they do not, then N games are awarded 840, Whereas if they do include a multiplier, N×M games are awarded 835 where M is the value of the multiplier. In this respect, it will be appreciated that there could be more than one multiplier and accordingly, in some embodiments, the multipliers could be multiplied together. In other embodiments, the highest multiplier that is available may multiply the number of game rounds. After the additional game rounds are awarded 835, 840, the method involves conducting the awarded games 845 before the method ends 850.

EXAMPLES

A number of examples of embodiments of the invention are illustrated in FIGS. 9 to 15.

Each of FIGS. 9-15 show a first video display 54A positioned immediately below a second video display is 54B. It will be appreciated that in practice, there may be a physical divide between the two video displays.

Example 1

Figure 9A:
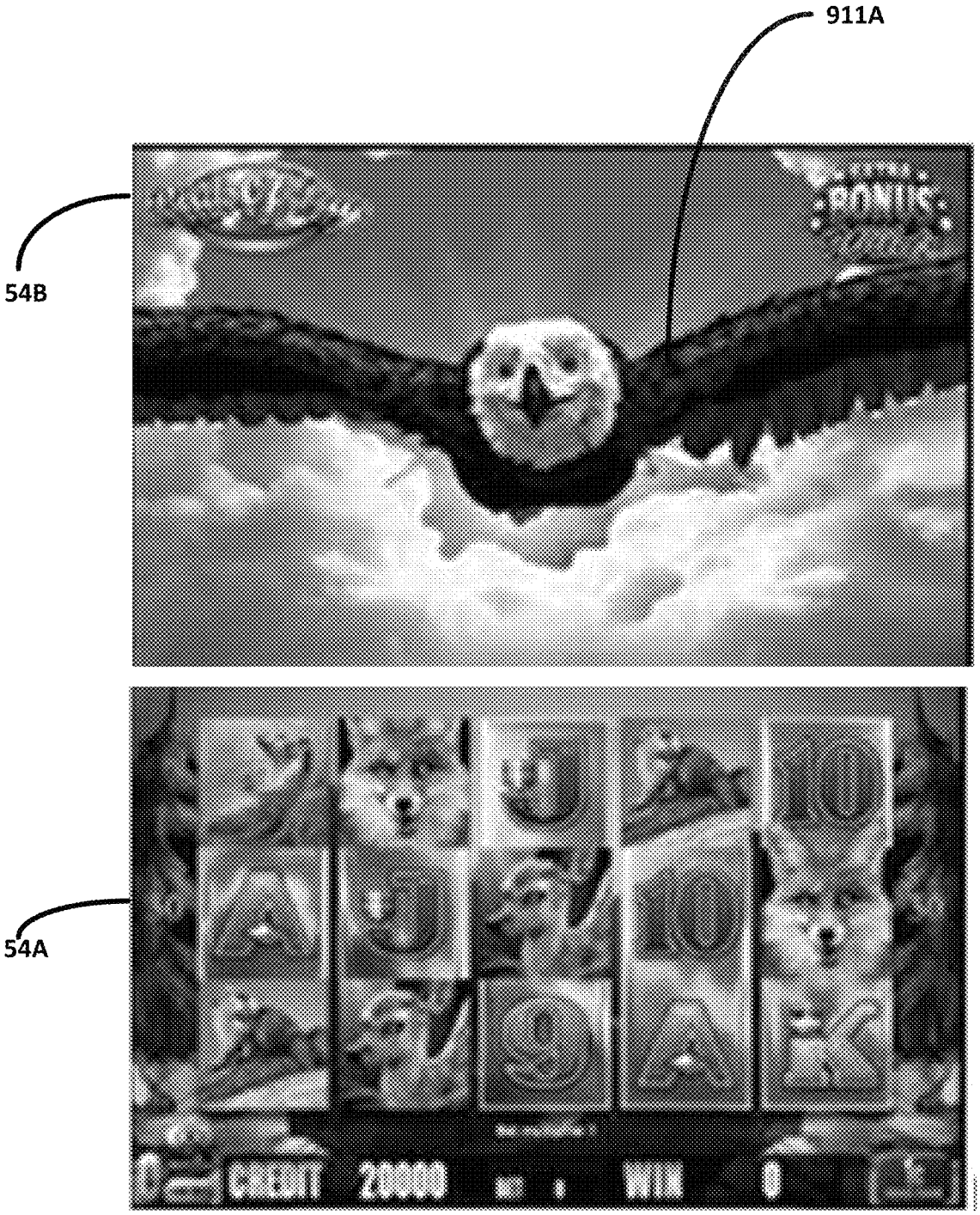
FIGS. 9A to 9J are screen shots of a game in accordance with a first example.
Figure 9B:
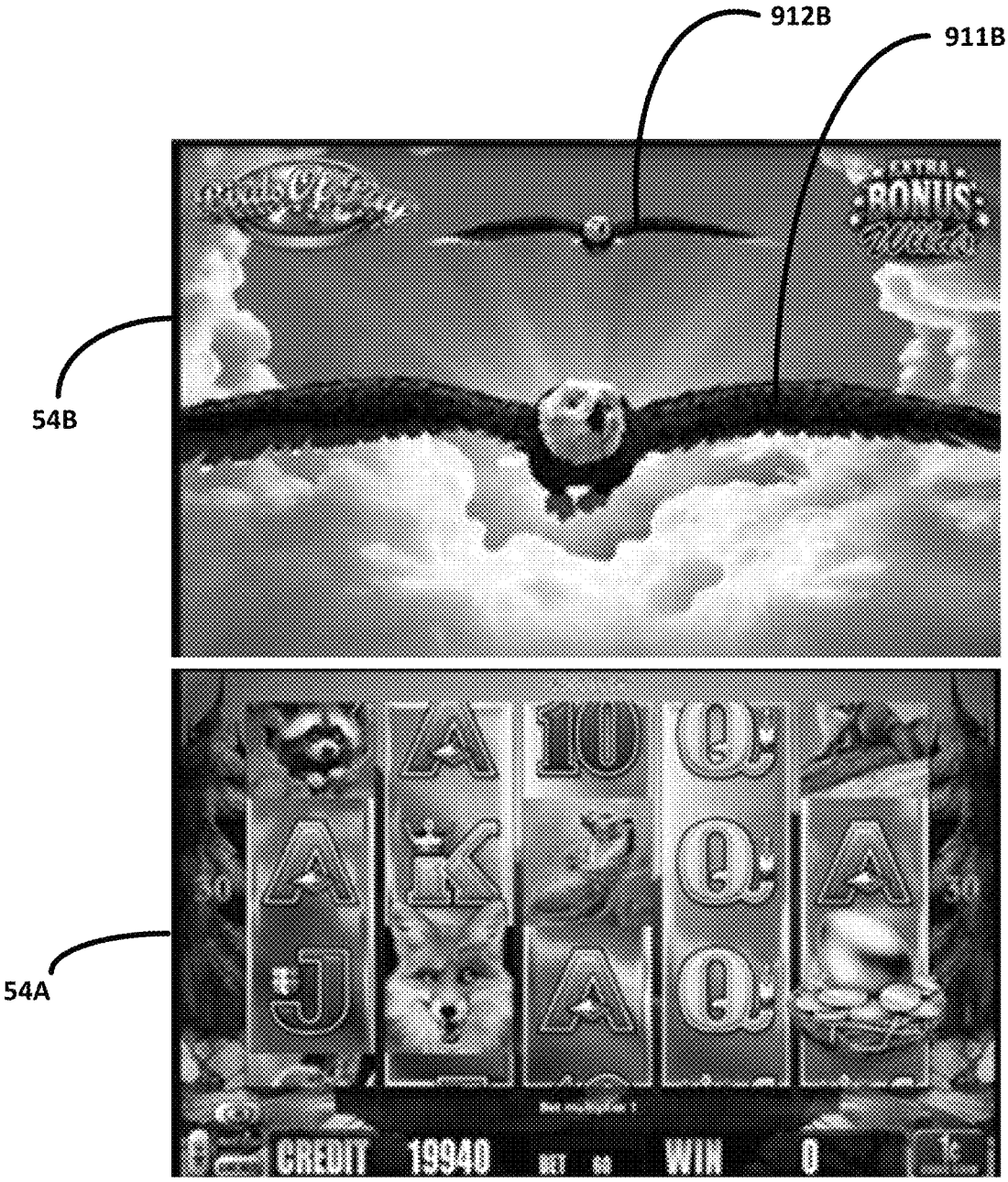
Figure 9C:
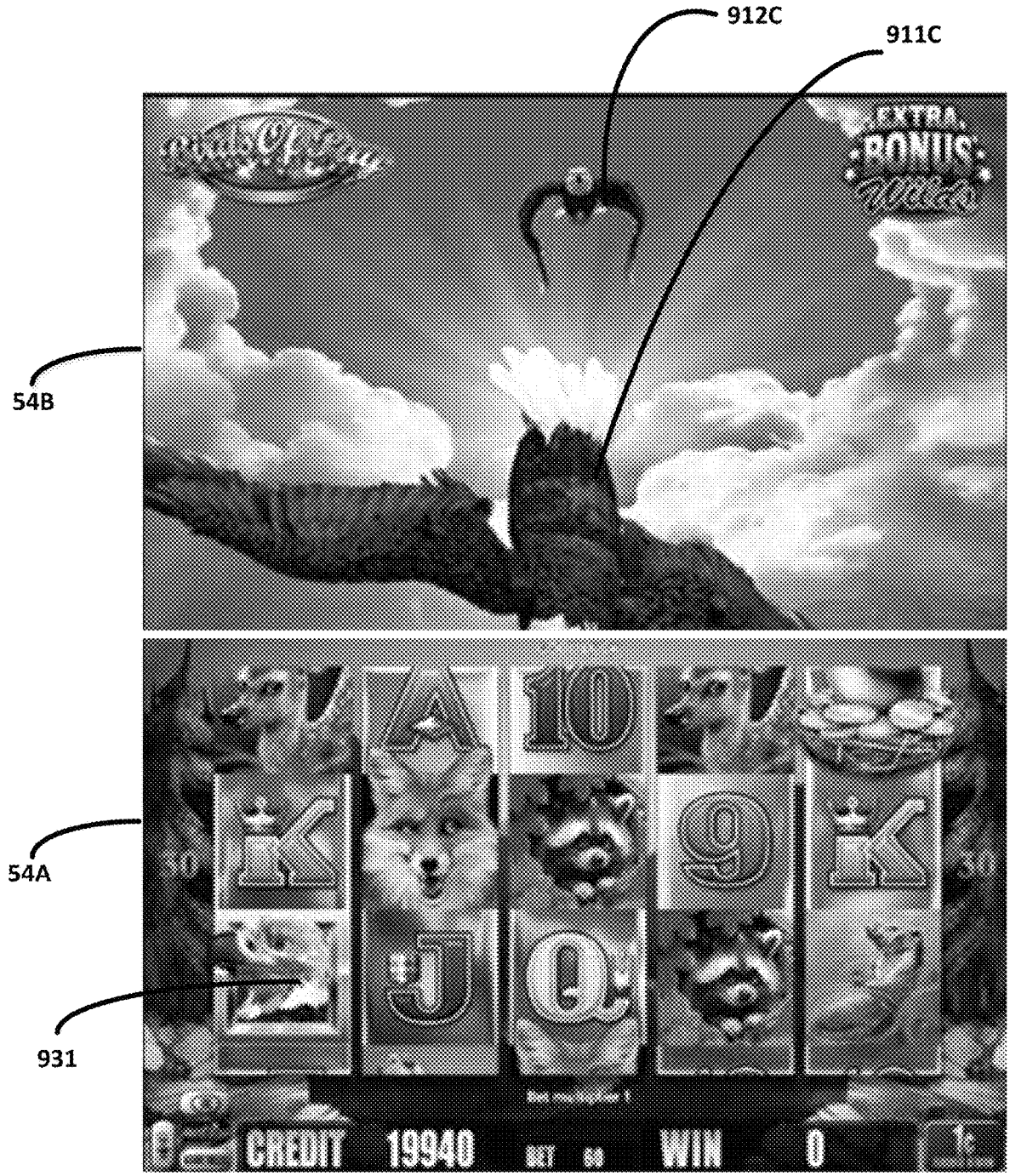
Figure 9D:
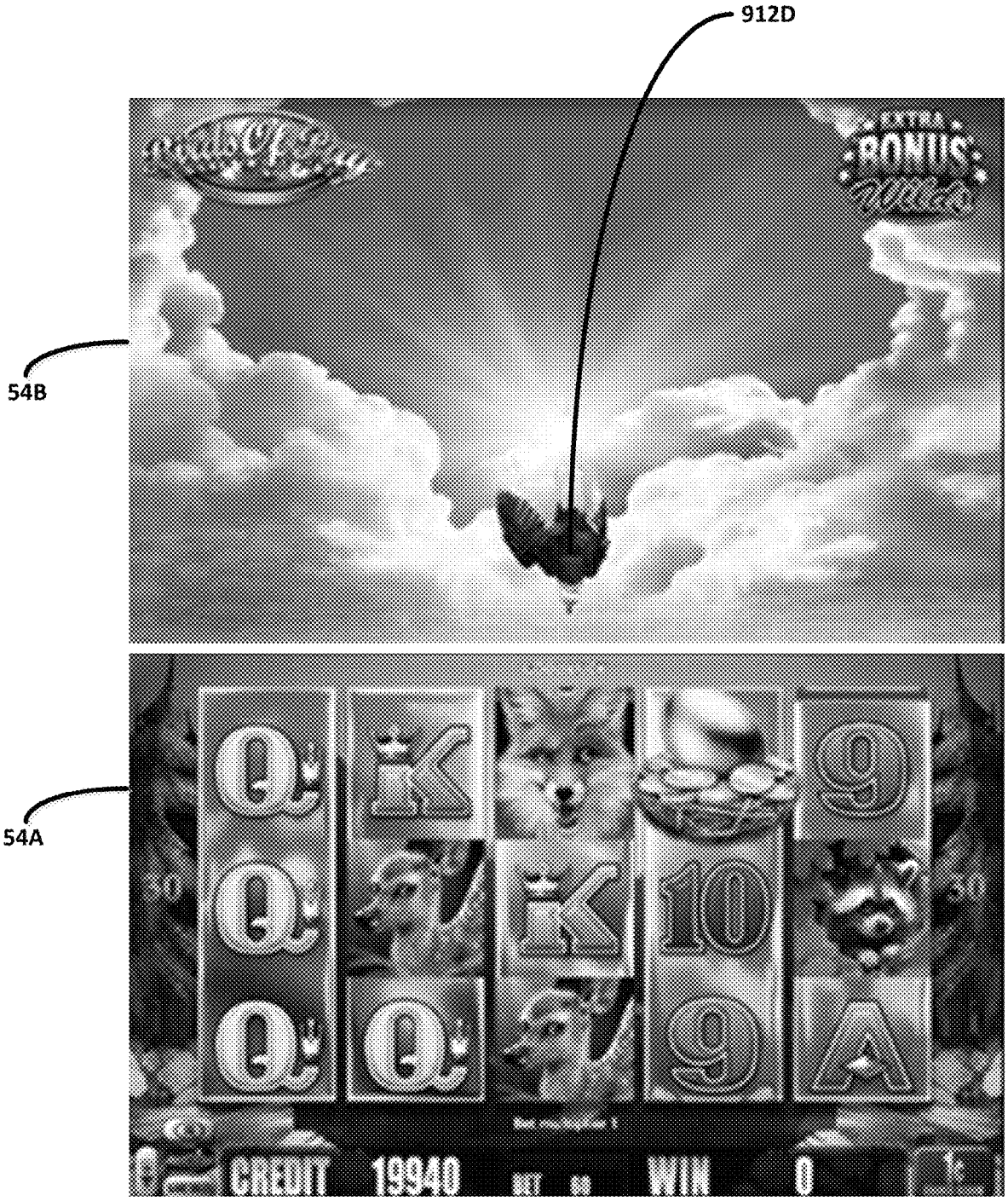
Figure 9E:
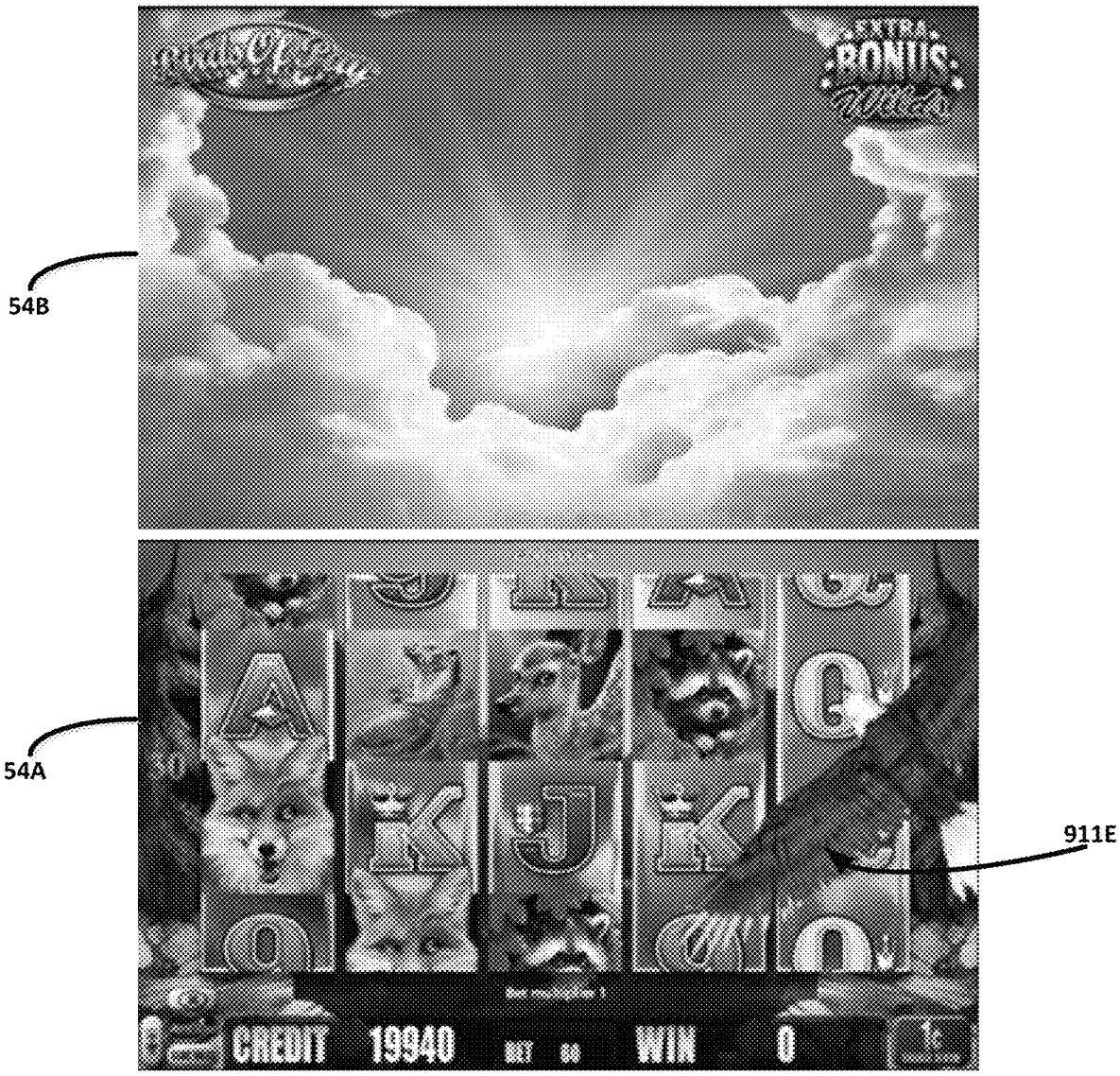
Figure 9F:
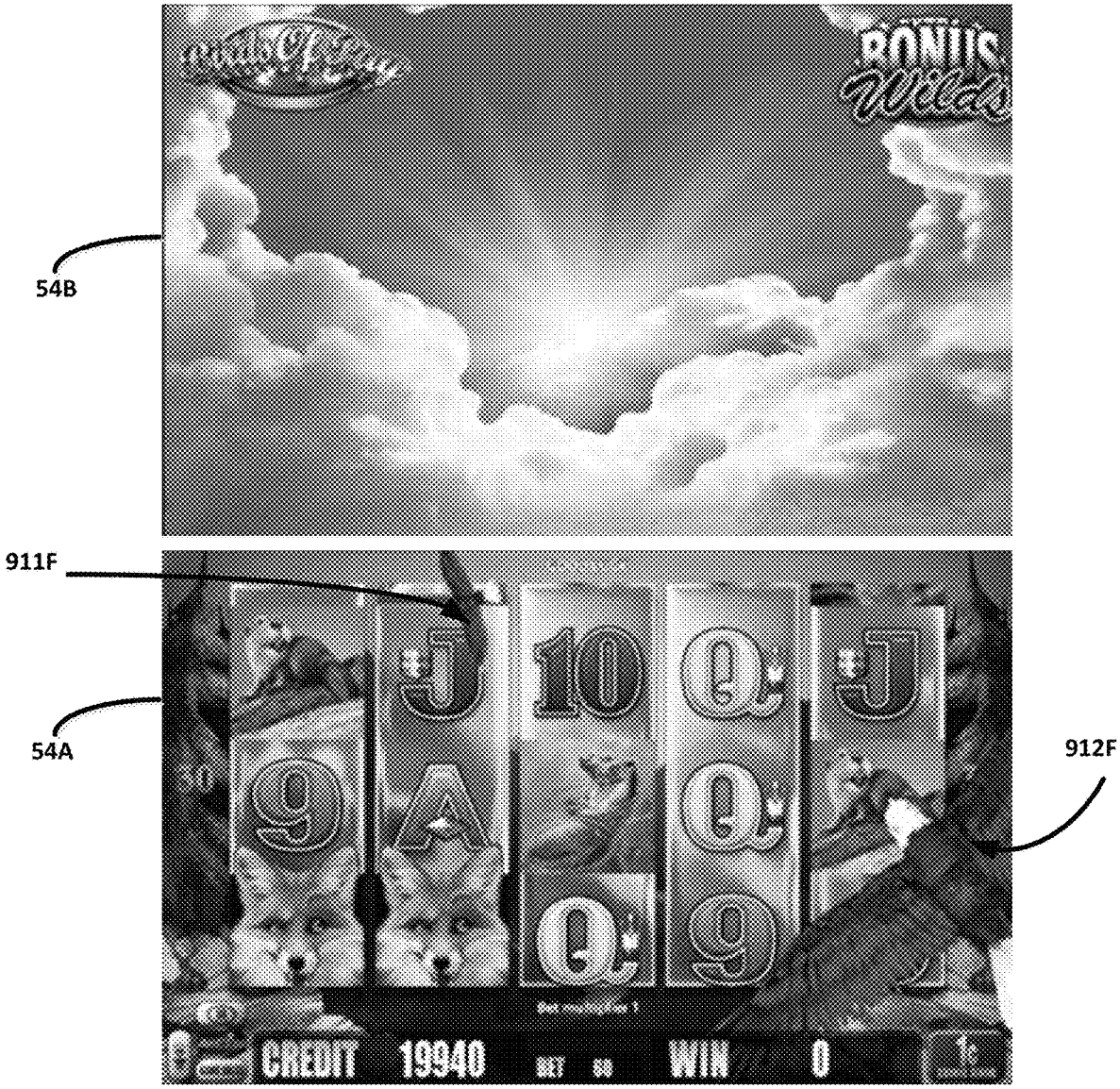

Referring to FIG. 9A, there is shown a symbol display 900A in the first video display comprised of fifteen symbols. The game controller controls an animated object in the form of a first bird character 911A to be shown in the top screen 54*b*. In FIG. 9C, the first bird character is shown at a new position 911*b* and has been joined by a second character 912*b*. In FIG. 9*c*, the first character is shown as a further new position 911C as it begins its descent towards the bottom screen. The second character is also shown in a new position 912C and in FIG. 9*d* the second character is shown in a further new position diving towards the bottom screen at position 912D. In FIG. 9E, the first character has entered the bottom display 54A at position 911A and in FIG. 9F the second character has joined the first character and they are displayed at positions 911F and 912F respectively. In this respect, it will be appreciated that the first character shown at position 911F is approaching the jack symbol in the top symbol display position of the second column symbol display position. It will also be appreciated that the symbols have changed during FIGS. 9A-9C corresponding to the movement of the reels by virtue of their spinning under control of the game controller.

Figure 9G:
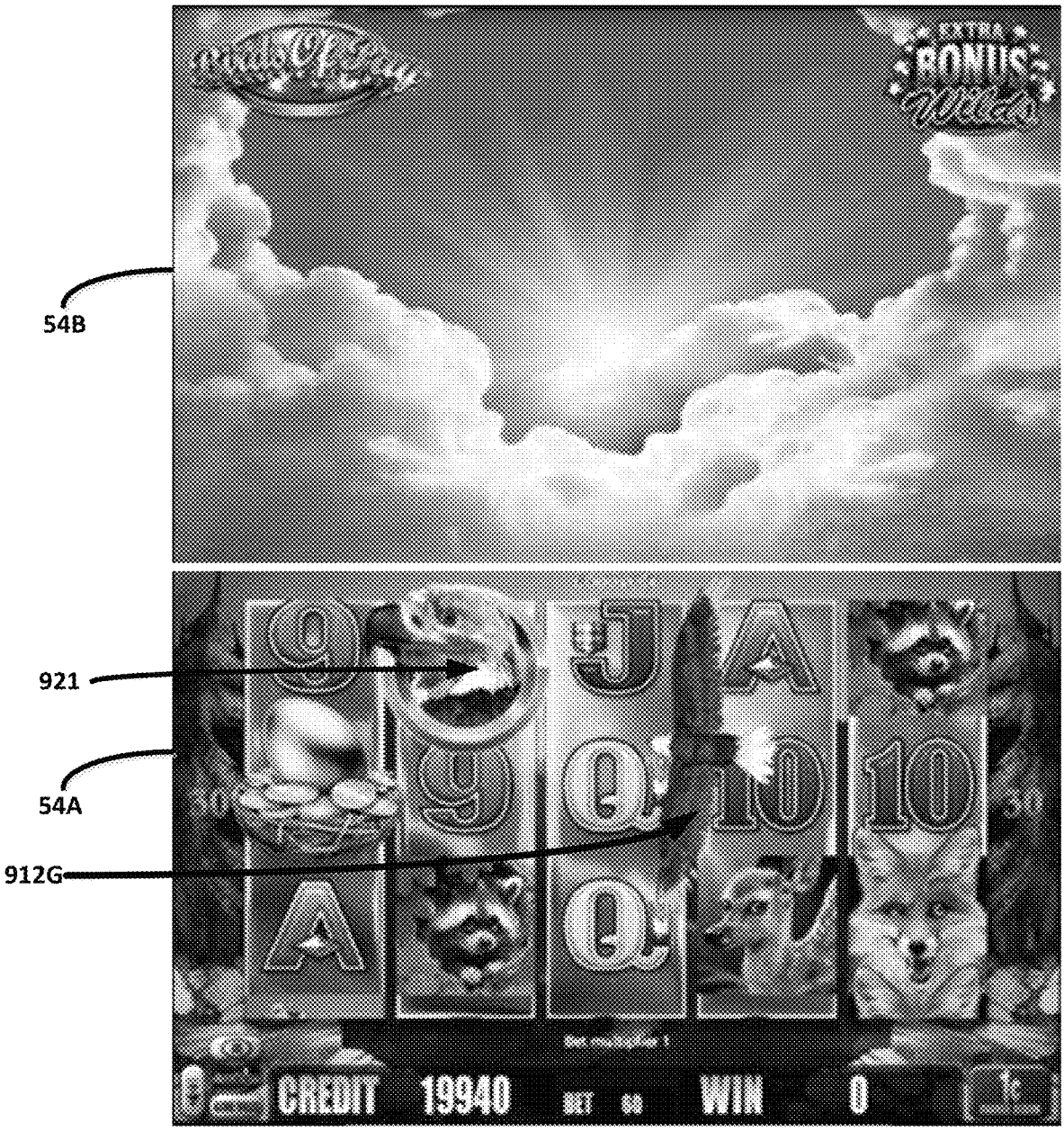
Figure 9H:
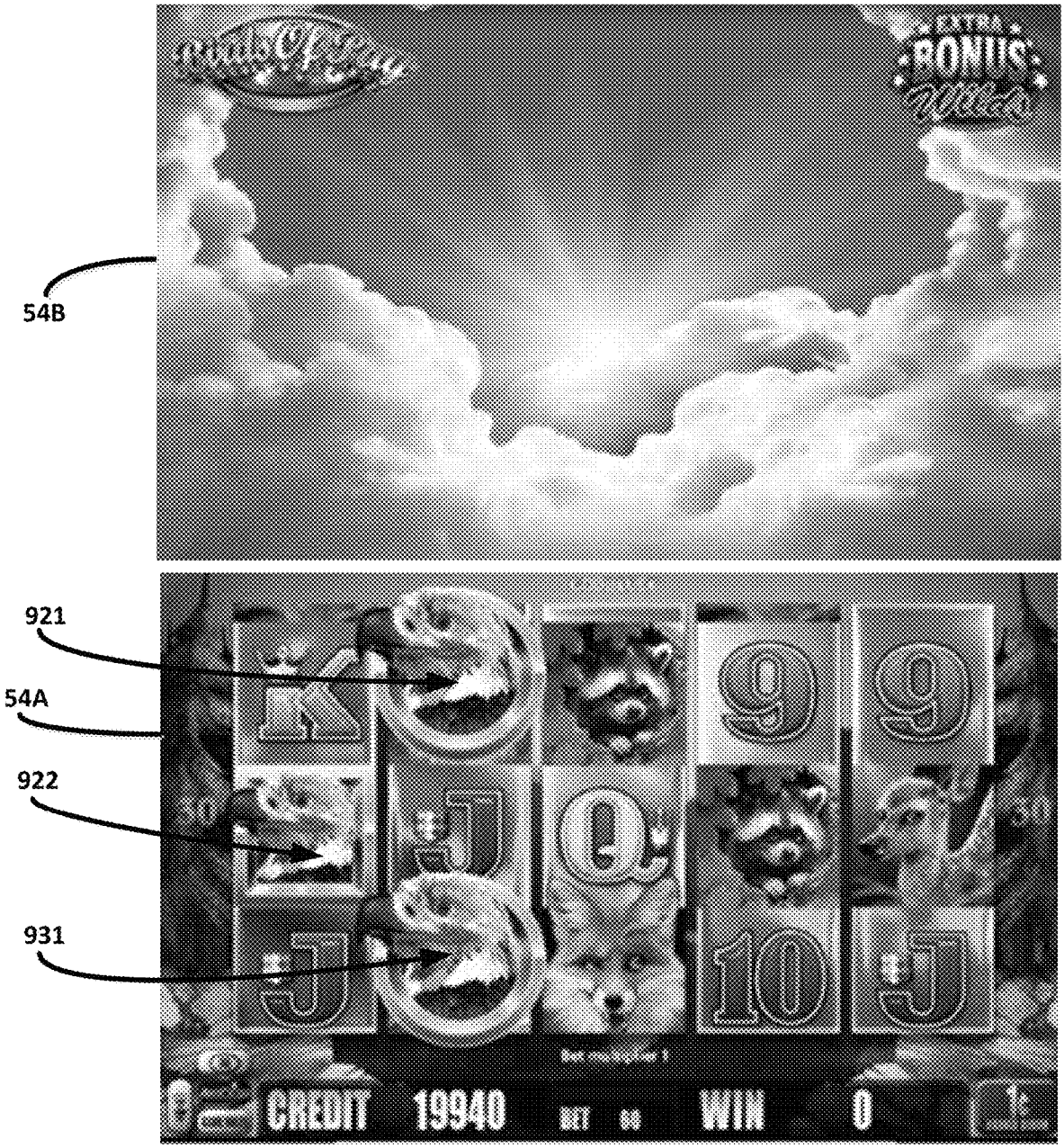

Referring now to FIG. 9G, the first character has now reached the top symbol display position of the second reel and has transformed into a first wild symbol 921. The second character 912G continues to be animated as moving throughout the bottom display 54B. In FIG. 9H the second character has changed into a wild symbol 922 displayed at the bottom symbol display position of the second column. It will also be appreciated that the selected symbols can include a normal wild symbol 931 not added by the wild symbol adder 622B but rather selected from the symbols on the reels.

Figure 9I:
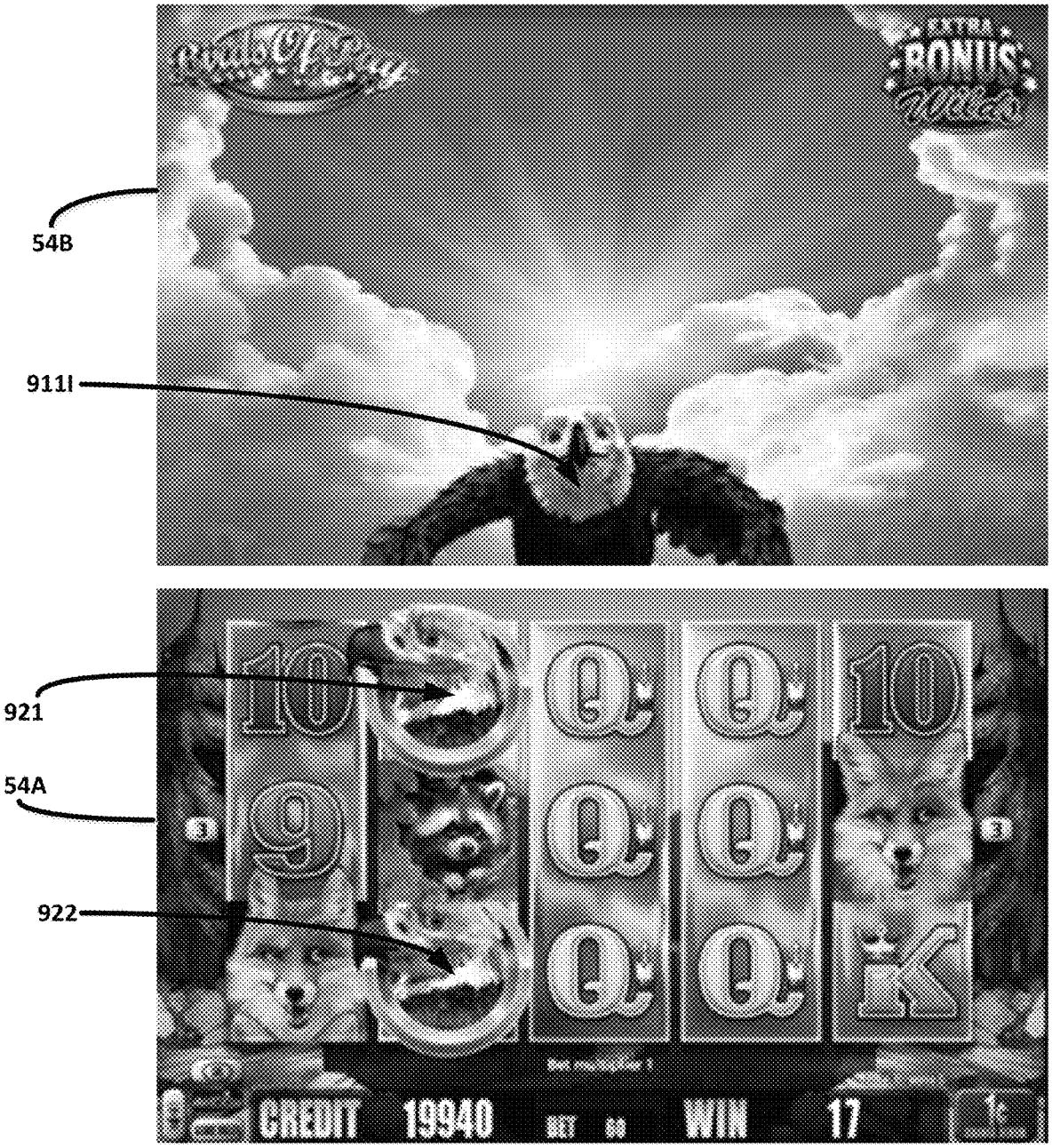

Referring to FIG. 9I, the first character is shown as moving back to the top screen 54B at position 911A and this corresponds to the stopping of the reels in the bottom position.

Figure 9J:
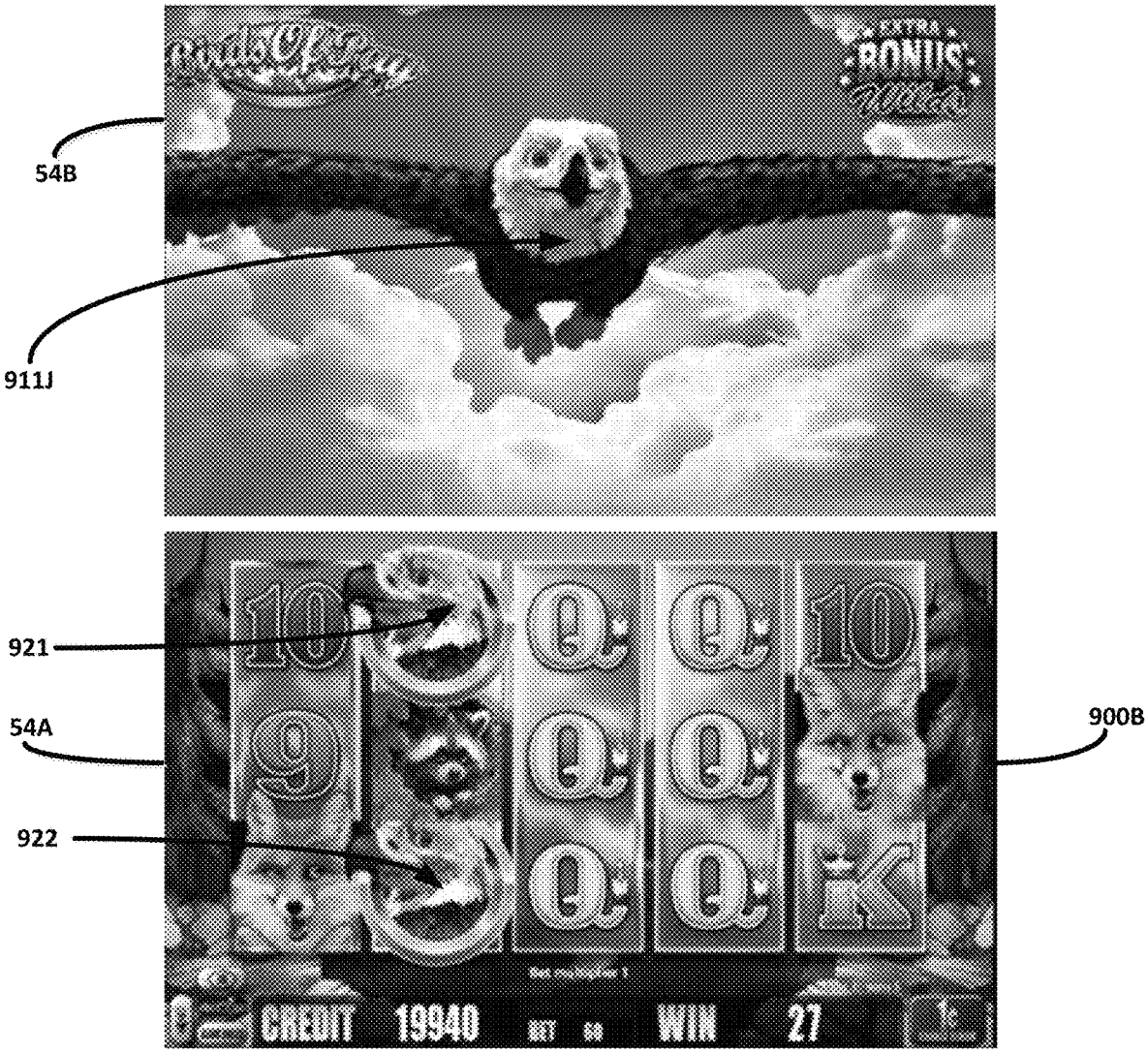

In FIG. 9J, the character reaches a final position 911J which indicates to the player that the symbol display 900B is finalised and will now be evaluated to determine whether to make any awards to the player based on the displayed symbols.

Example 2

Figure 10A:
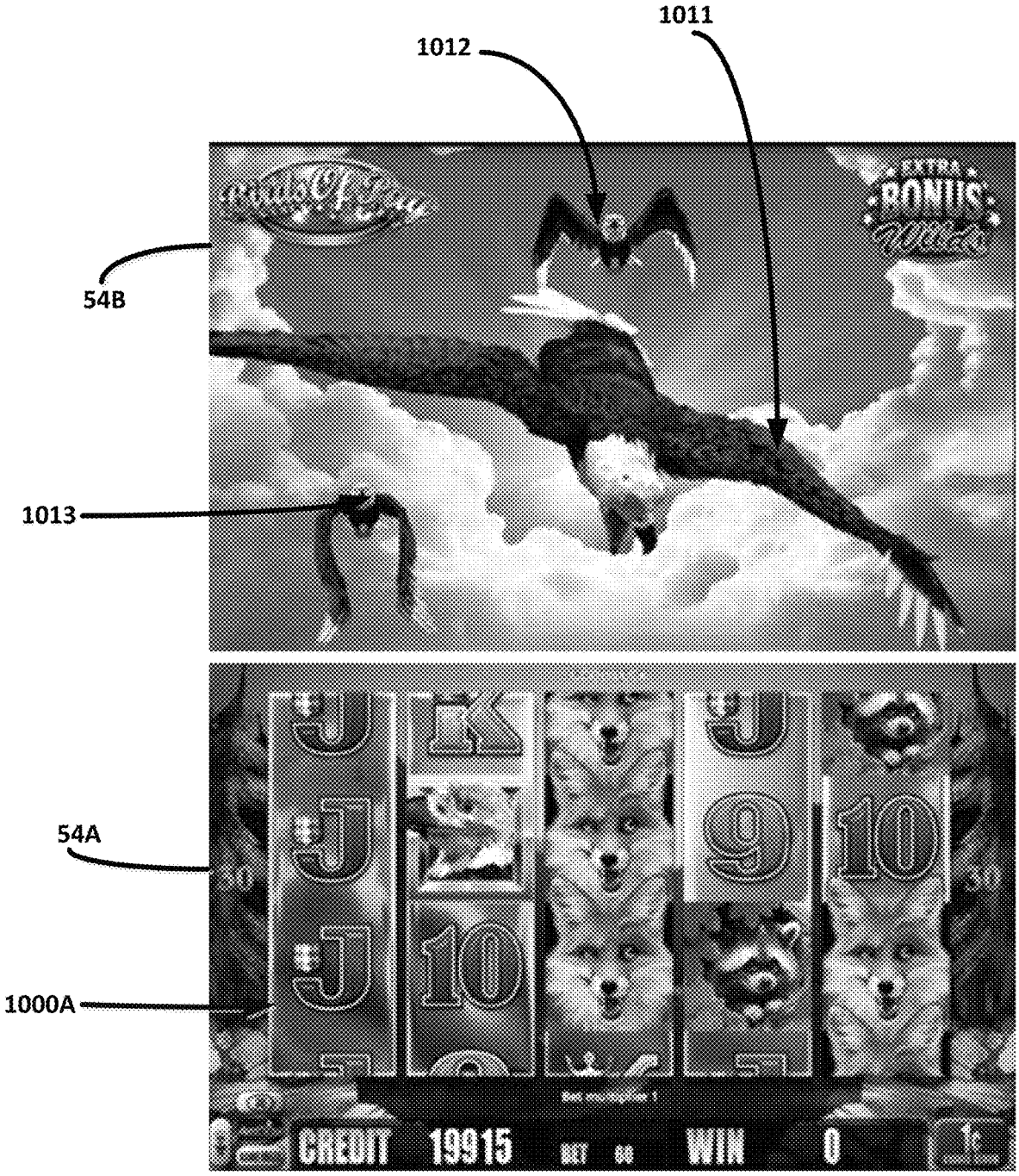
FIGS. 10A to 10E illustrate an example of awarding the multi-wild symbol.
Figure 10B:
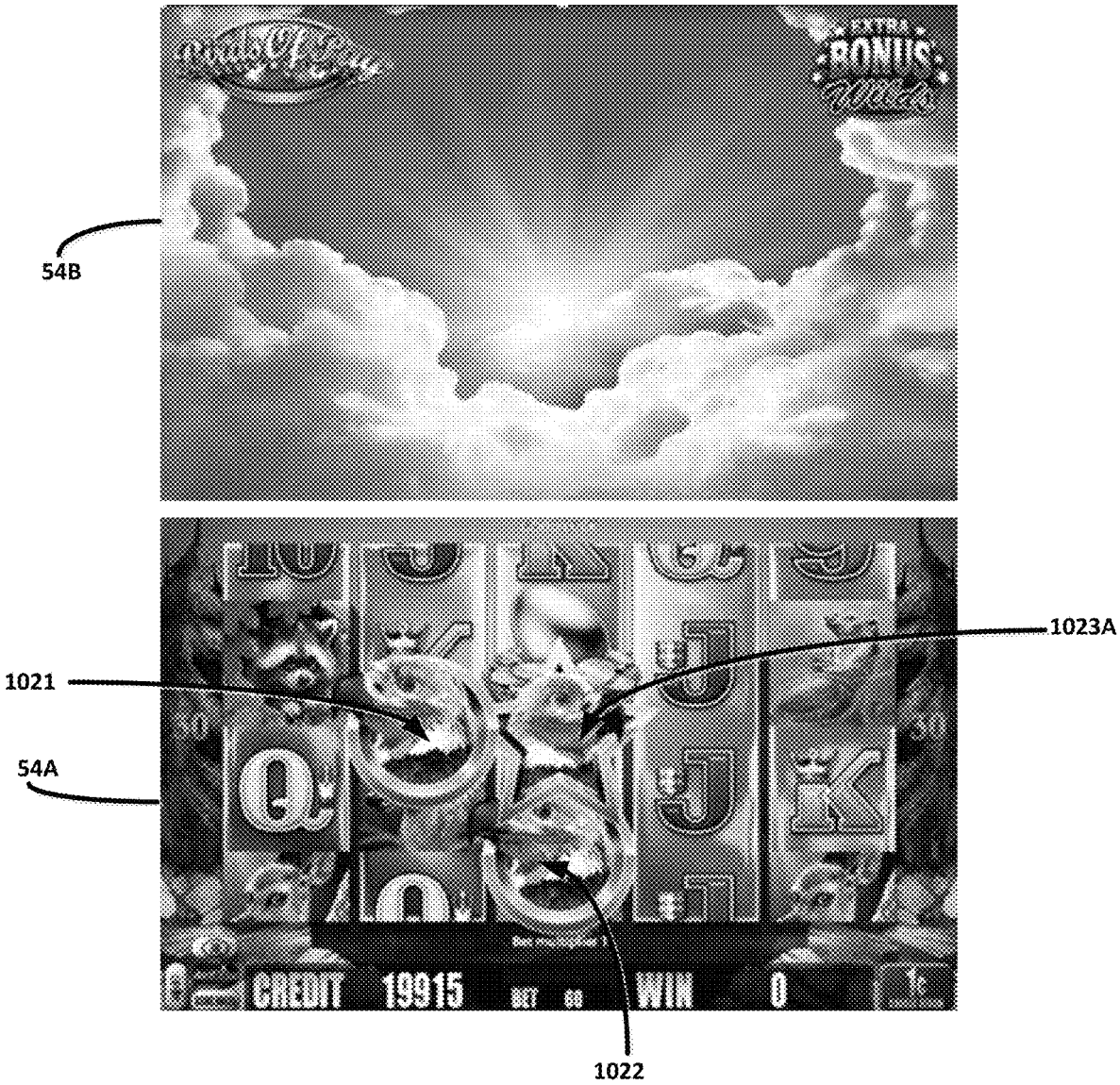

FIGS. 10A to 10E illustrate an example of a game controller awarding the multi-wild symbol. In this example, first, second and third characters 1011, 1012 and 1013 are initially displayed in the top screen and move to the bottom screen 54A in a manner similar to that described above. As shown in FIG. 10B this results in the positioning of a single wild symbol 1021 at the middle position on the second reel and a single wild symbol 1022 at the bottom position on the third reel while a multiple wild symbol 1023A is displayed at the middle position of the middle reel. It will be appreciated that the multiple wild symbol is displayed as visually distinct from the other wild symbols.

Figure 10C:
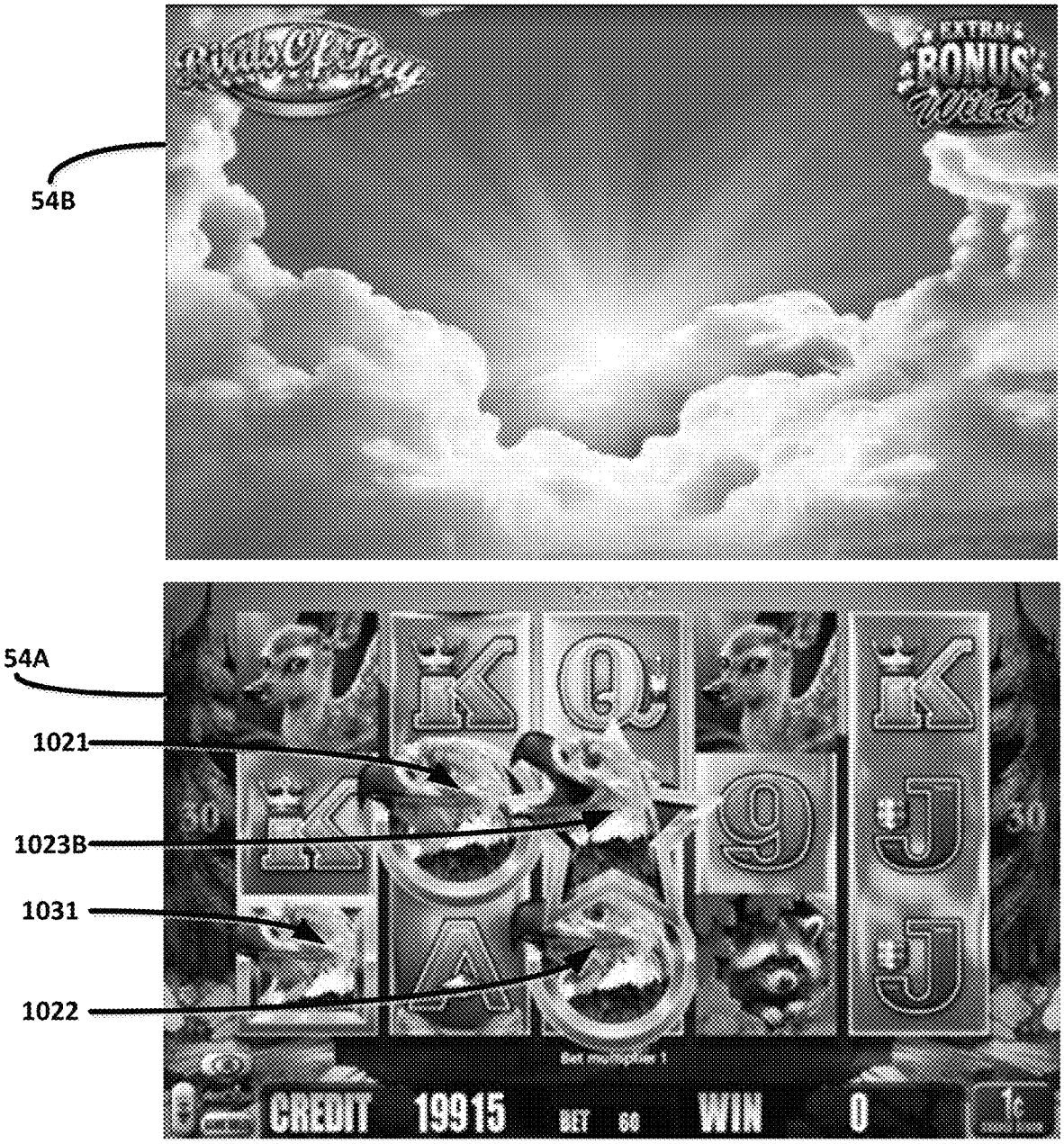

Referring to FIG. 10C, the multi-wild symbol 1023B is animated to show the bird character of the multi-wild symbol 1023, summoning additional wild symbols.

Figure 10D:
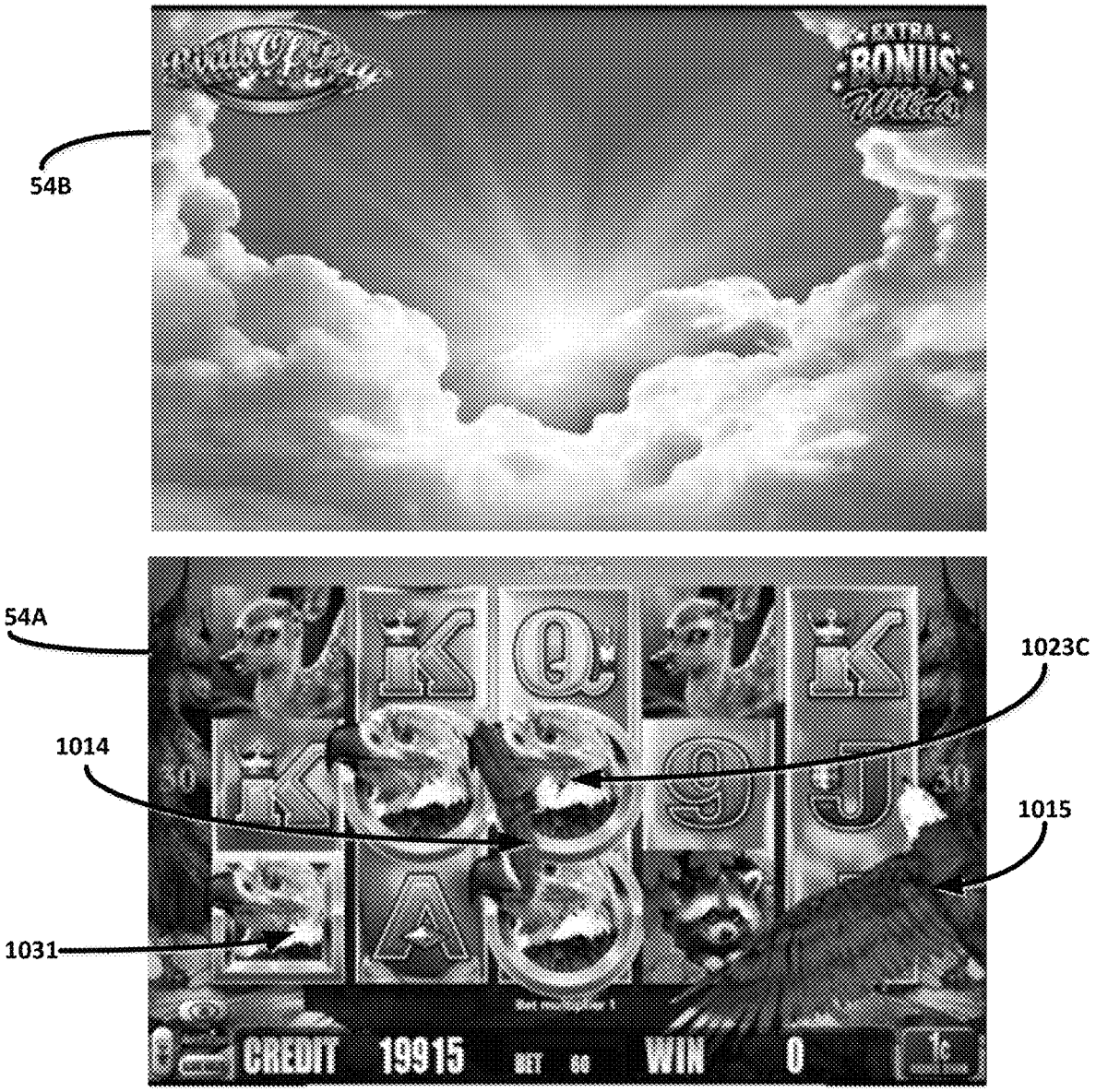

In FIG. 10D, the multi-wild symbol has changed to a single wild symbol 1023C and additional characters 1014 and 1015 are added to the display. In this example, the multiple wild symbol adds four extra wilds.

In embodiments of the invention, any number between 2 and 9 wilds can be used for the multi-wild depending on the number of wilds to be added to the display.

Figure 10E:
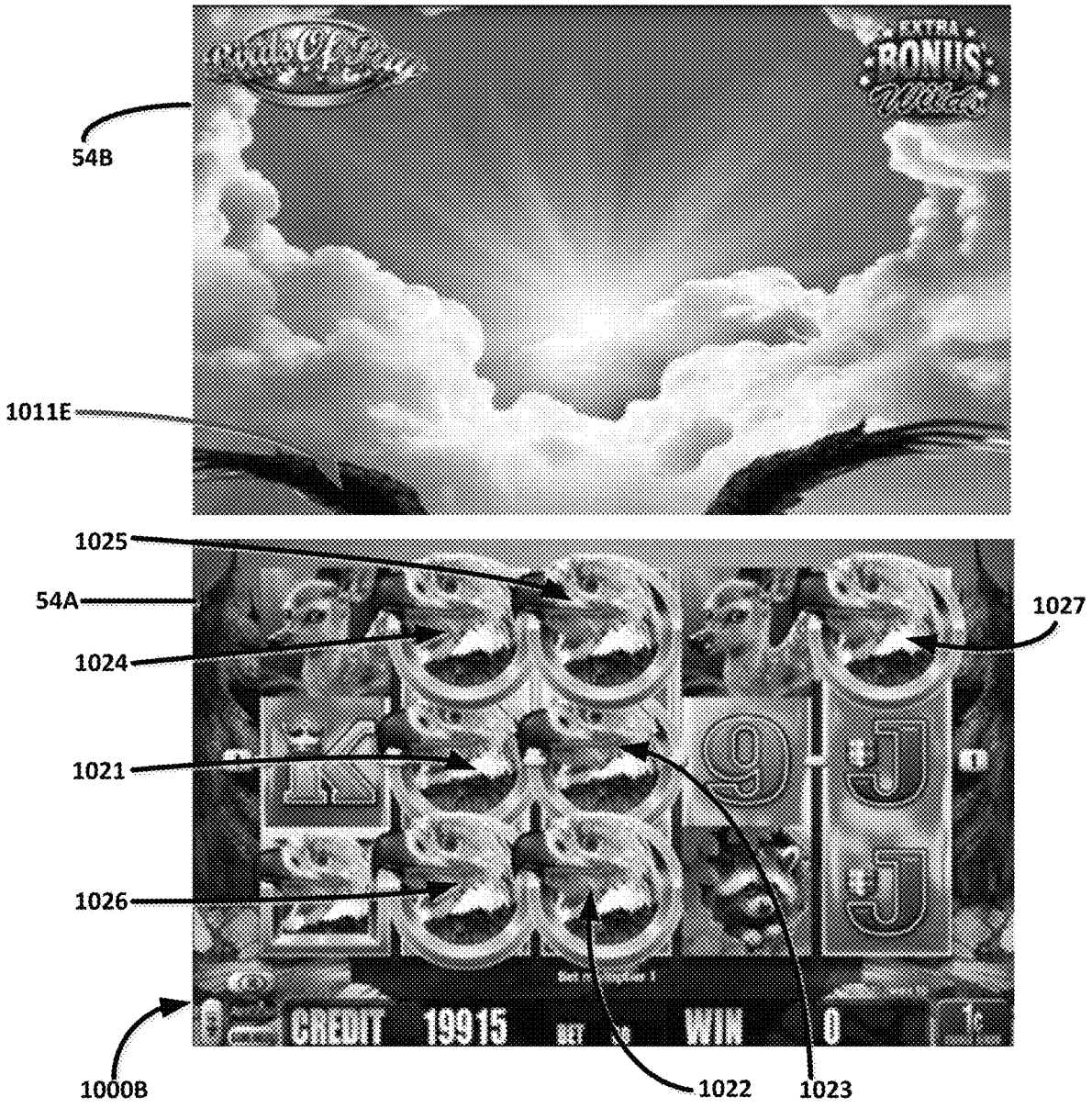
Figure 11A:
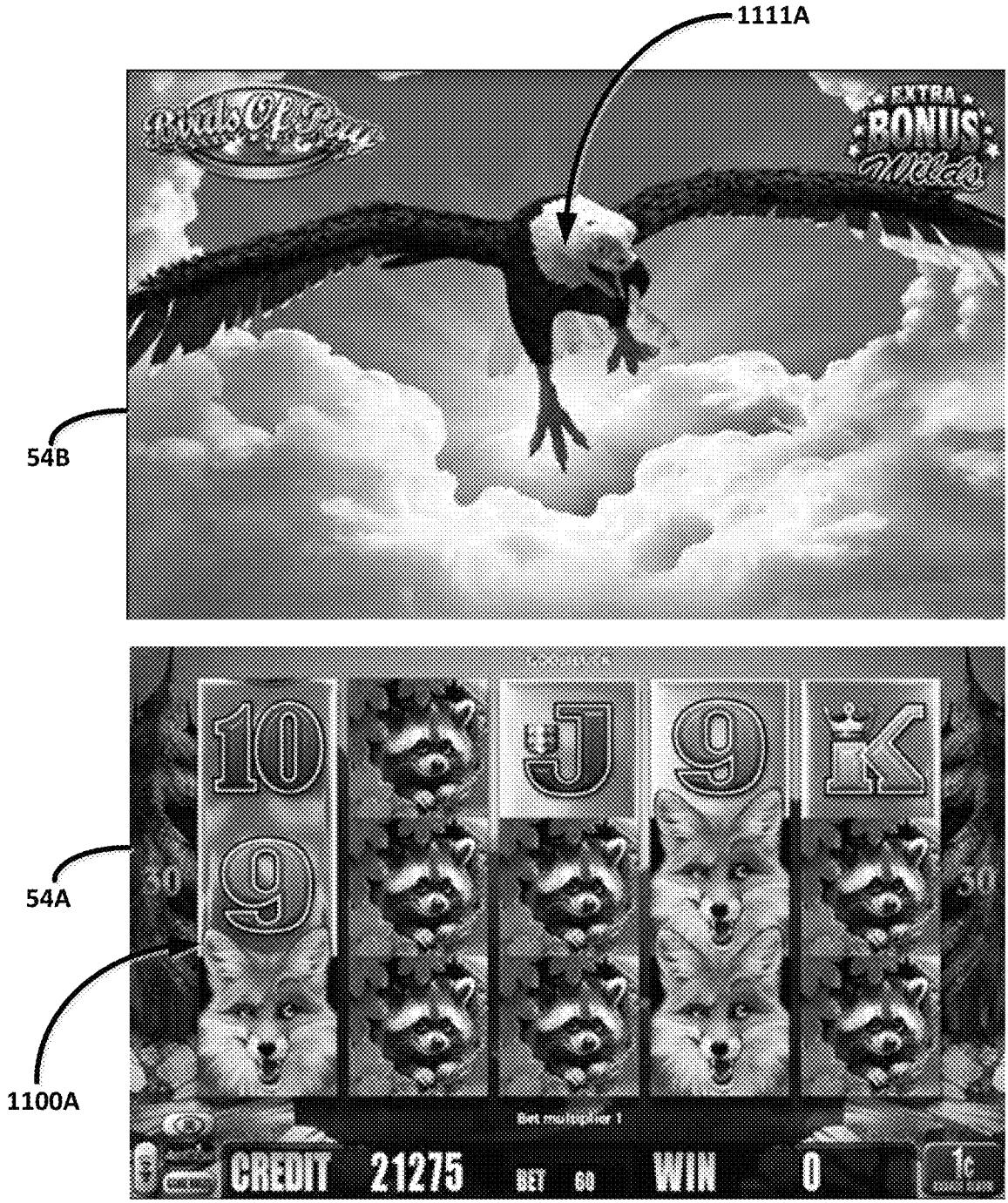
FIGS. 11A to 11D illustrate an example of awarding a large number of wild symbols.
Figure 11B:
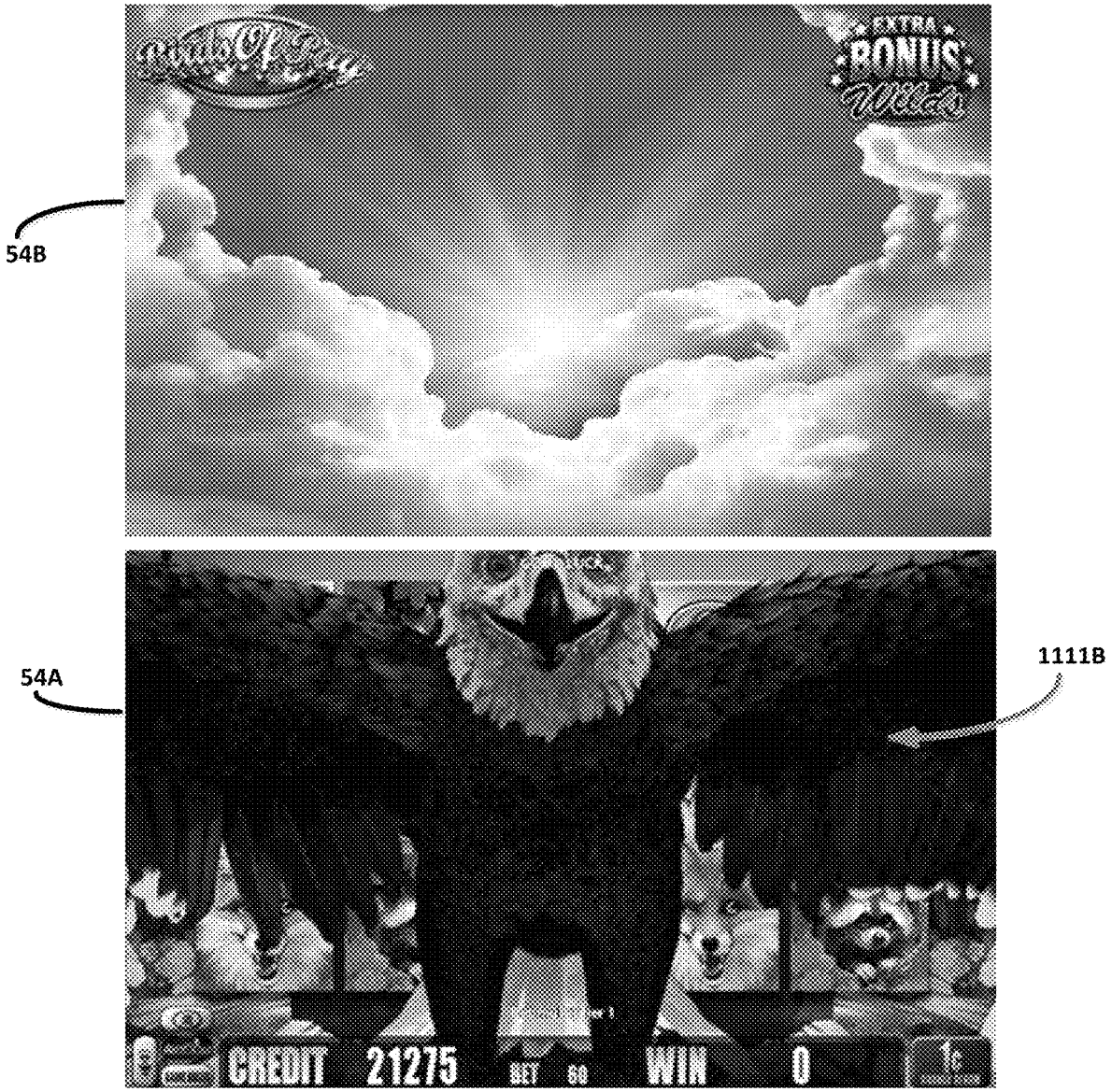
Figure 11C:
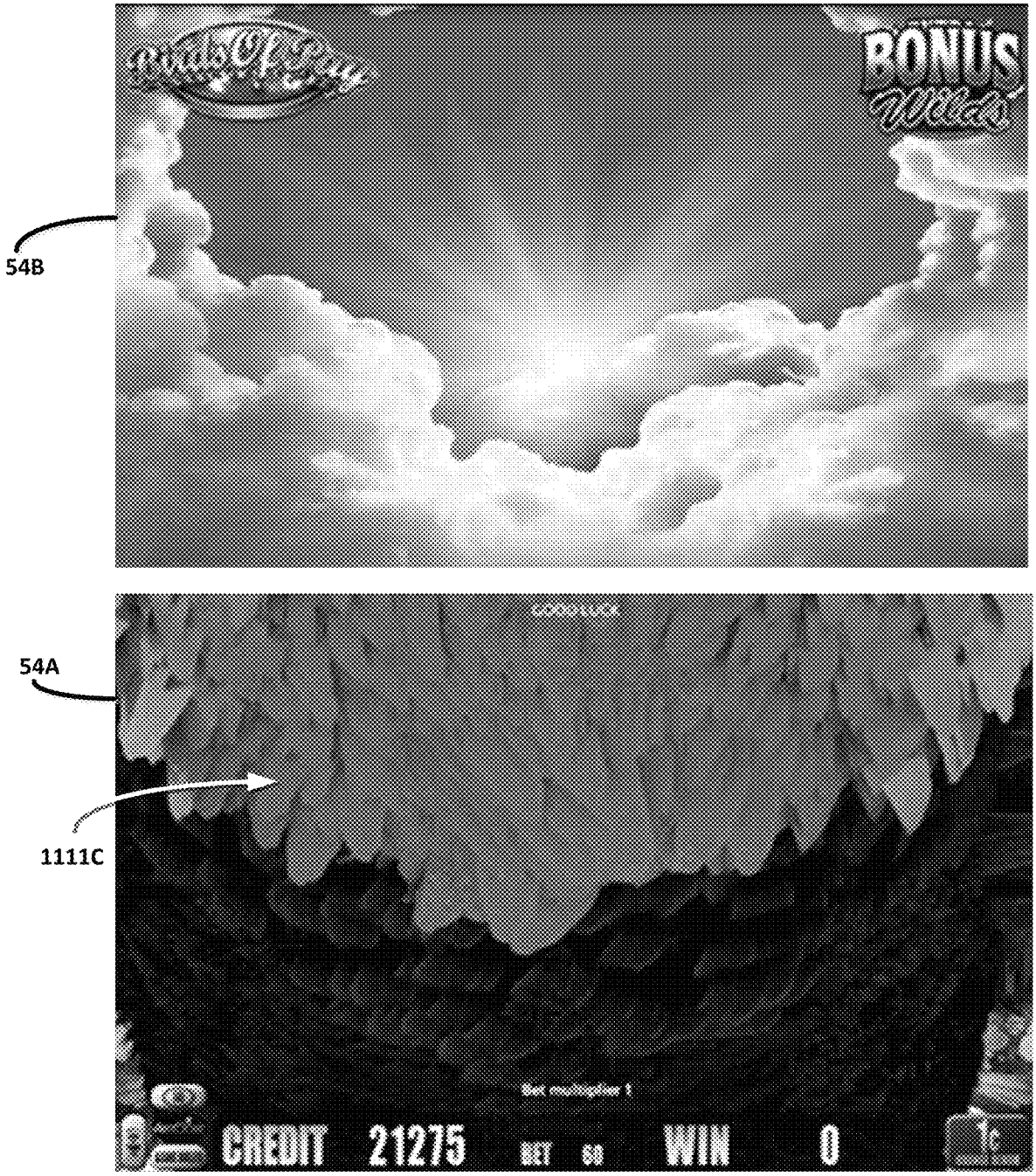
Figure 11D:
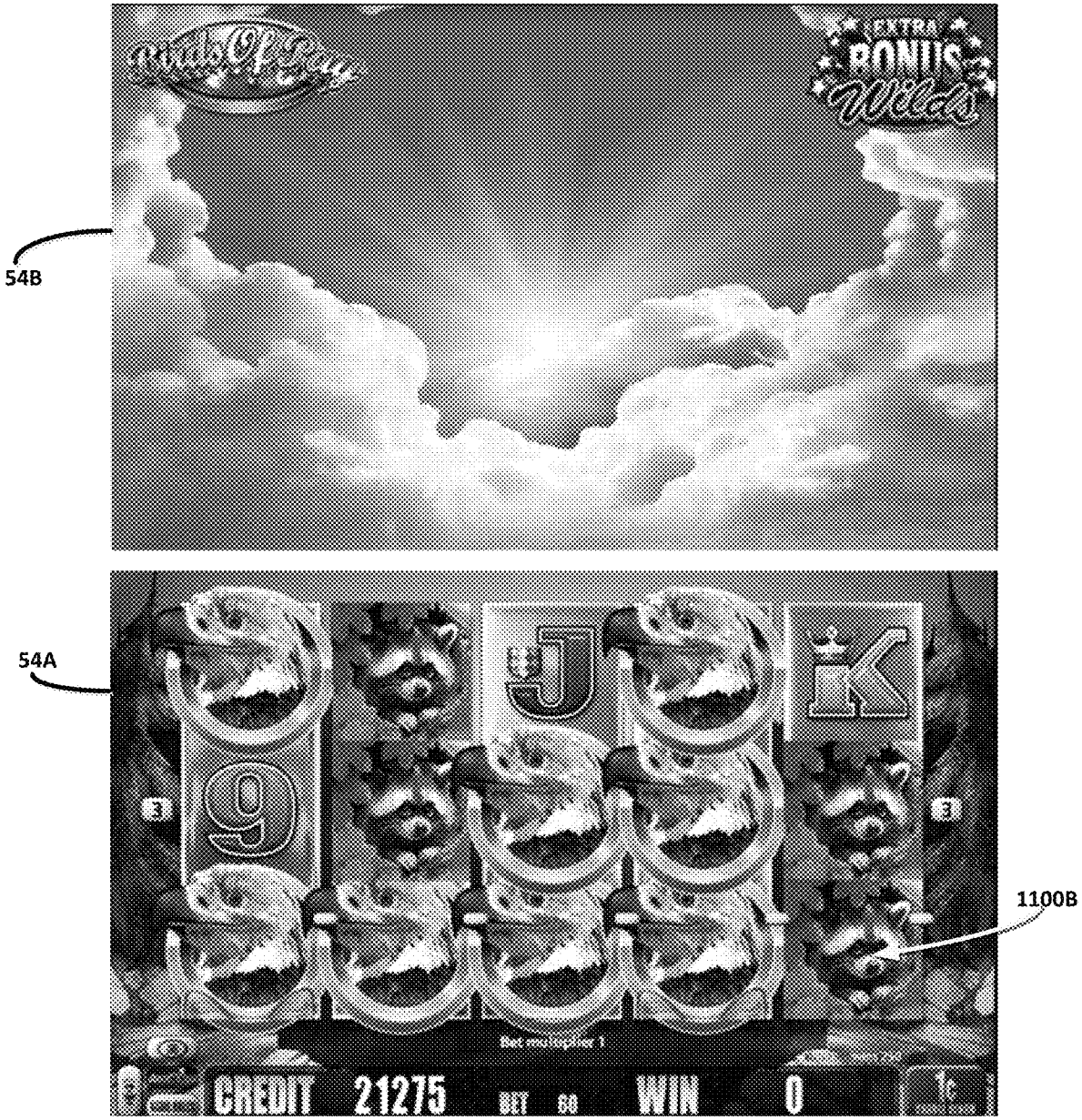

FIG. 10E shows that seven wilds have been ultimately added to the symbol display 1000 to form final symbol display 1000B incorporating eight wild symbols which is then evaluated. That is, there are seven single wild symbols 1021-1027 incorporated into the symbol display in addition to one wild symbol selected from the reels. Two of the added wilds were added as single wilds and five of which come from the adding of the multiple wild symbol.

Example 3

In this example, where a large number of wilds are awarded, an alternative form of animation is used. In this example, a character 1111A is shown as moving from the top display in FIG. 11A to the bottom display when there is an initial symbol display 1100A in the bottom display. In position 1111B, the character is shown as flying towards the player of the game such that the player is shown in the character in close up 1111C in FIG. 11C before the character moves out of the way and reveals the modified symbol display 1100B in FIG. 11D.

Example 4

Figure 12A:
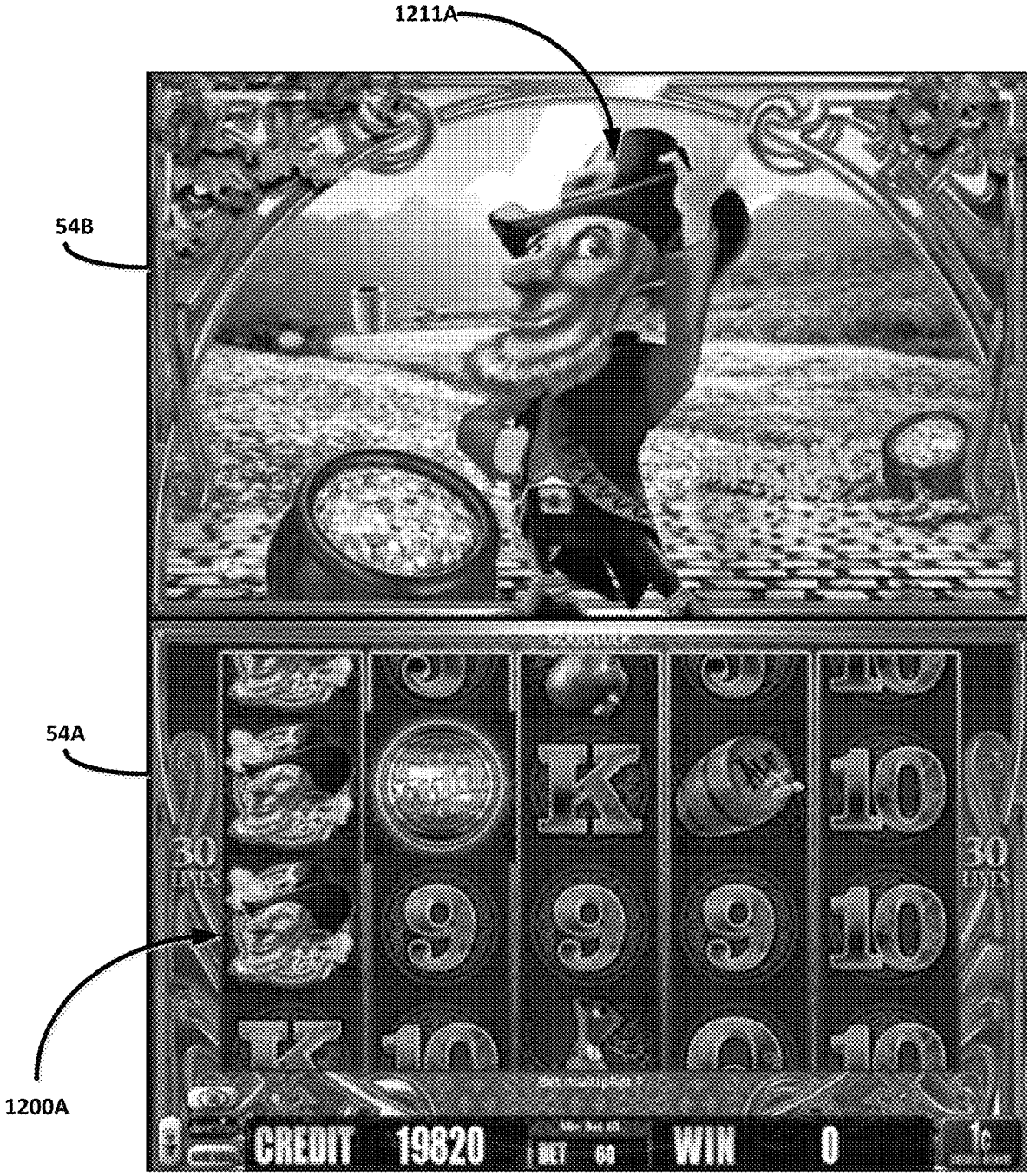
FIGS. 12A to 12C illustrate an alternative example of awarding single wild symbols.
Figure 12B:
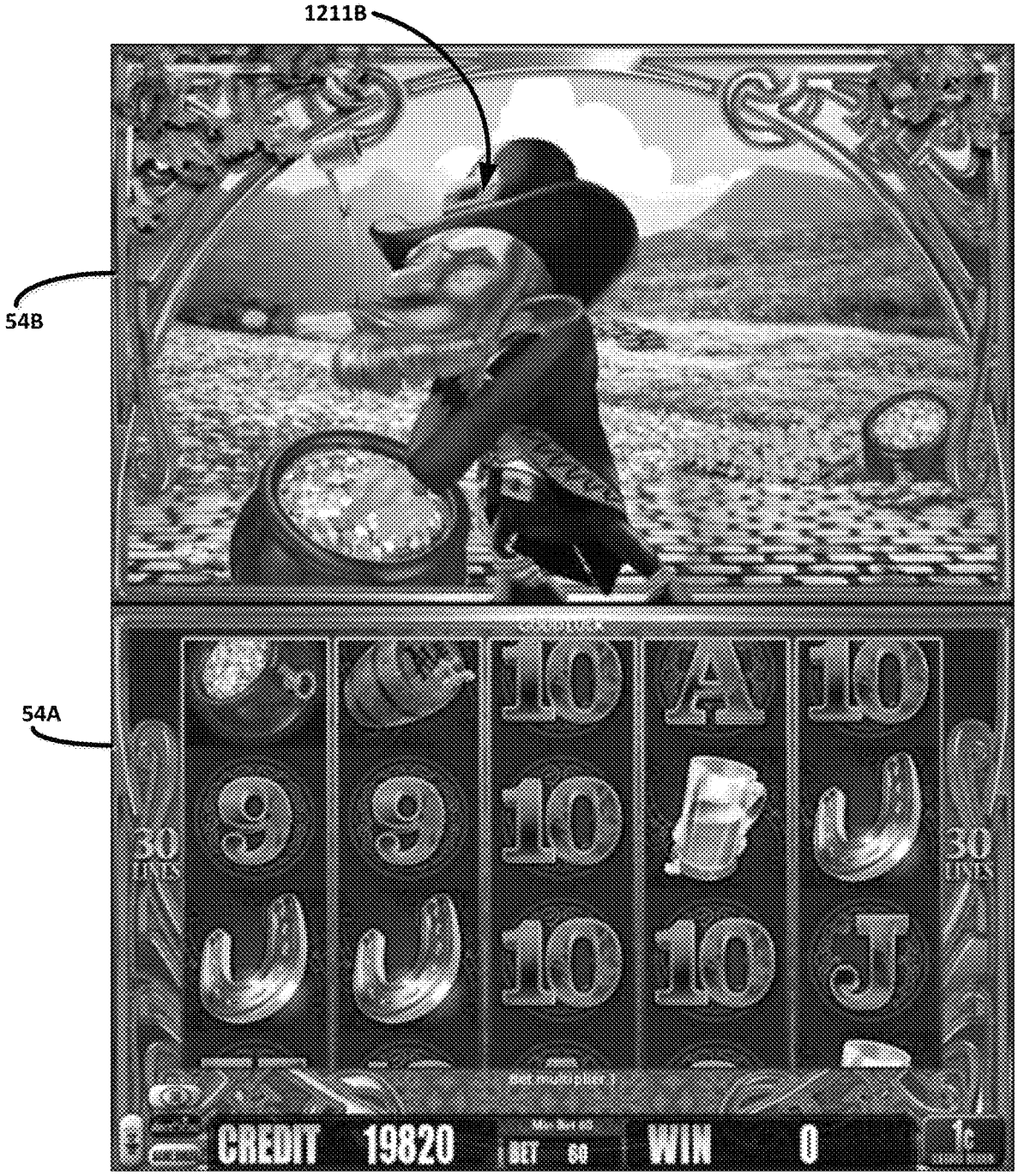
Figure 12C:
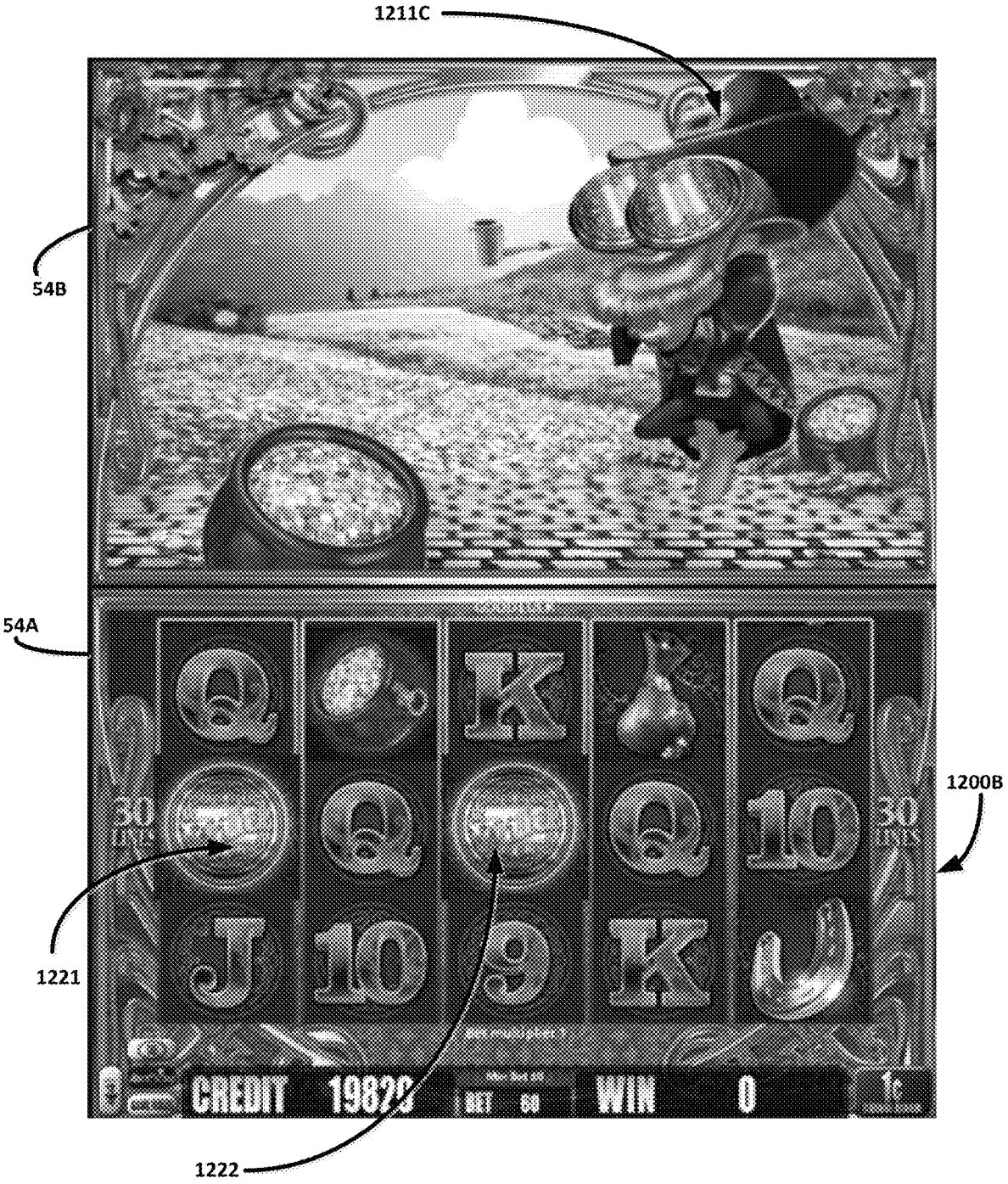

Referring to FIGS. 12A to 12C there is shown an example using an alternative character in the form of a leprechaun with a bag of gold 1211. Again, the reels spin on the first display 54A while the first part of the wild awarding animation occurs in the second display area 54B. In the example, single wild symbols are being awarded. The leprechaun reaches into the bag as shown in display position 1211B and throws one or more handfuls of coins from the bag to the lower display. As shown in FIG. 12C, each handful of coins is shown as landing at a symbol display position and turning into a wild symbol 1221, 1222 to form a modified symbol display.

Example 5

As shown in FIG. 13 shows an alternative example of an animation of the awarding of a multi-wild symbol. In this example, the multi-wild symbol animated object takes the form of a four leaf clover 1312 which is thrown by the leprechaun.

Figure 13A:
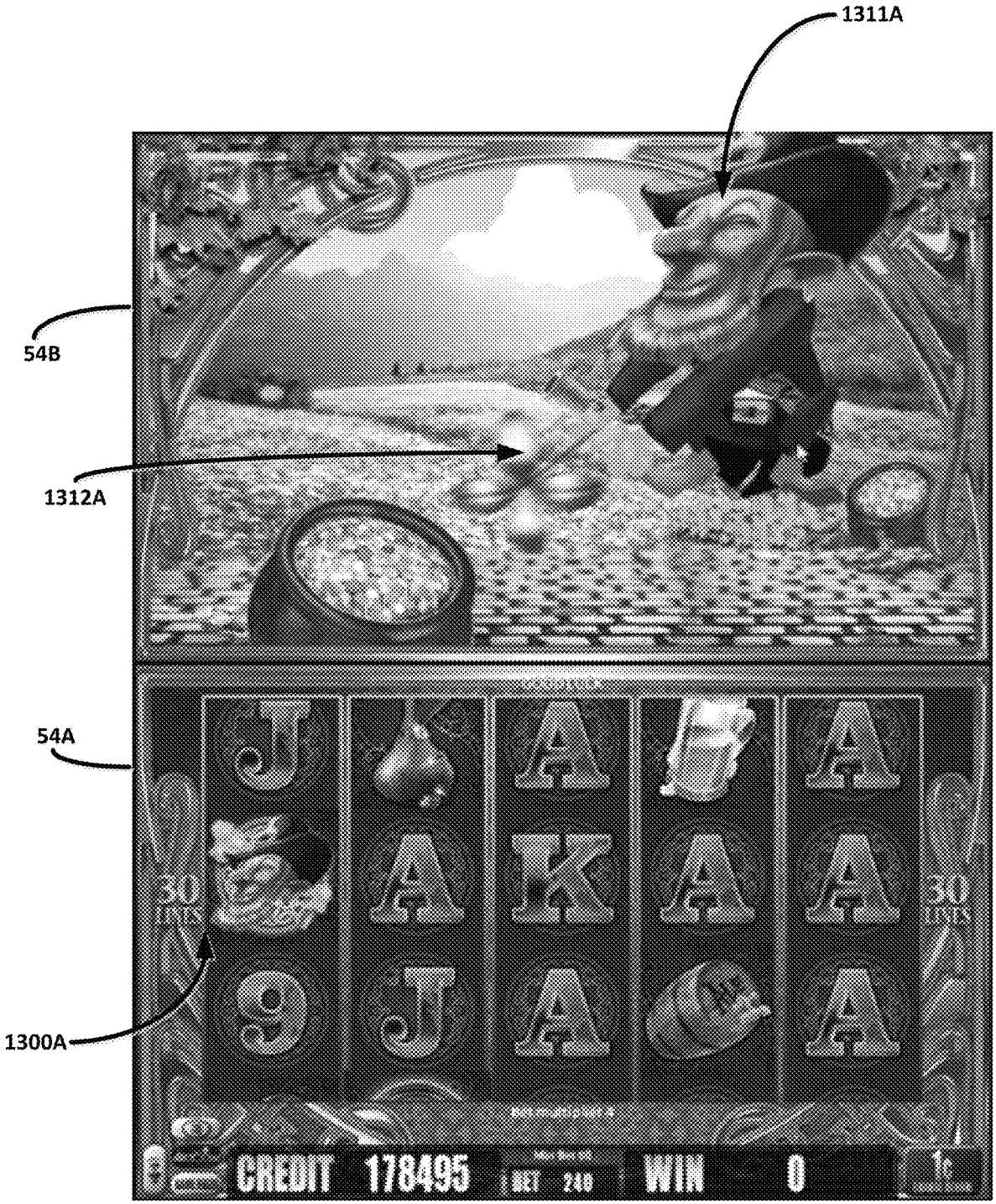
FIGS. 13A to 13C illustrate an example of awarding the multi-wild symbol.

In FIG. 13A, the multi leaf clover is shown at a first position 1312A in the top display 54B as thrown by the leprechaun 1311A.

Figure 13B:
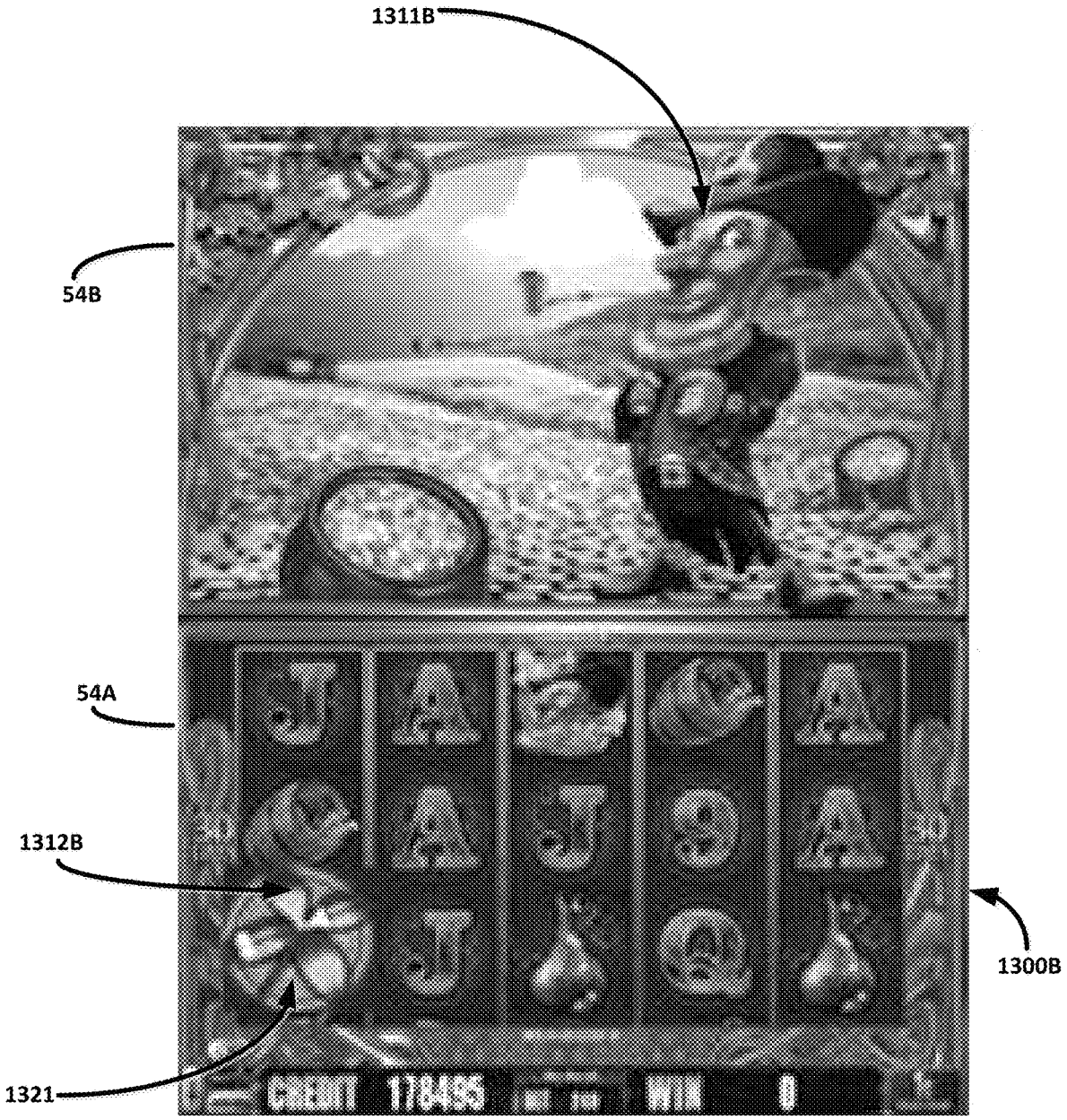
Figure 13C:
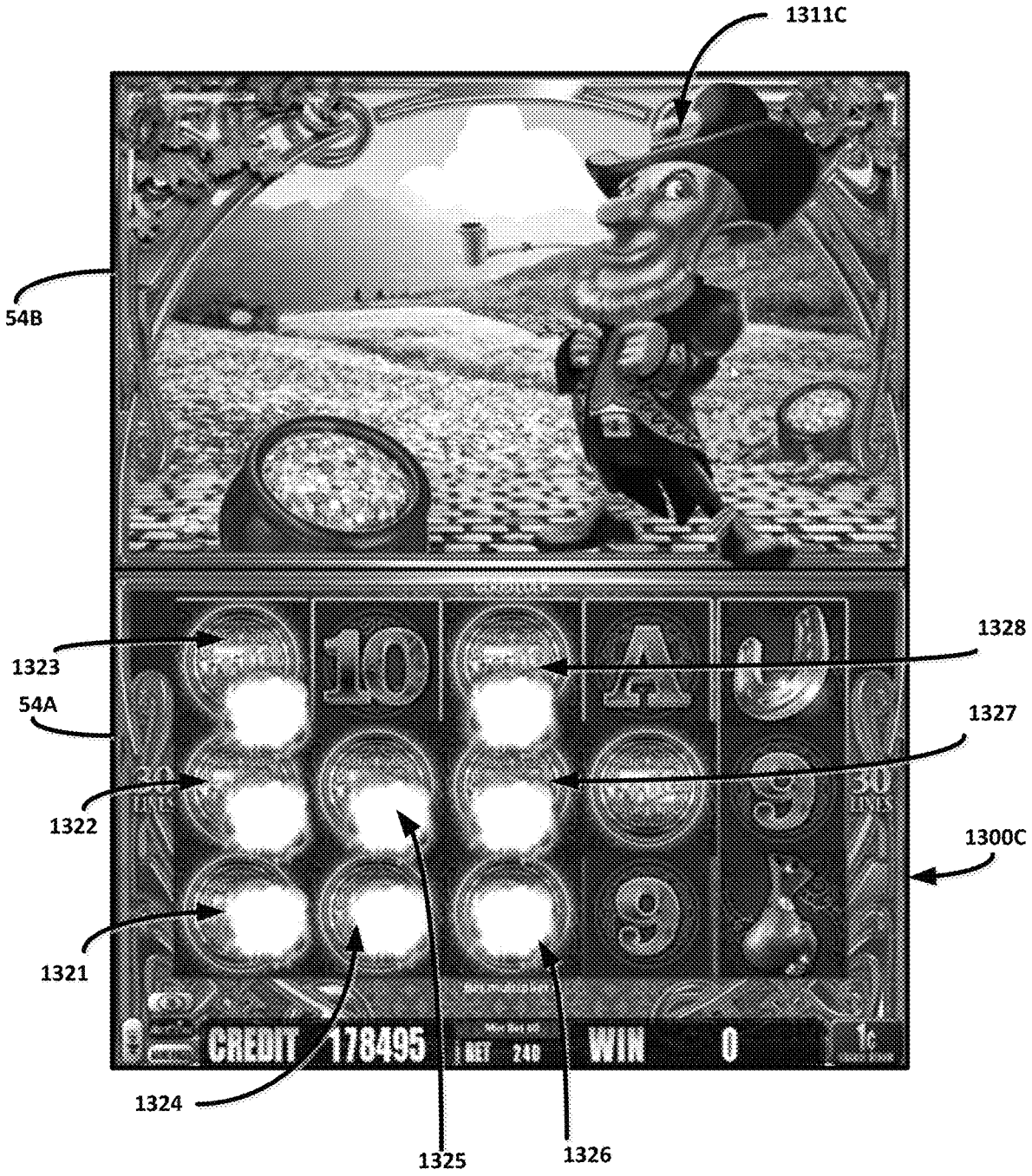

As shown in FIG. 13B, the four leaf clover lands at the bottom position on the first reel shown by the four leaf clover animated object 1312B. It can be seen at the position beneath the four leaf clover has turned into a wild symbol 1321 which then results in the addition of seven wild symbols at random positions in the symbol display 130C as shown in FIG. 13C. That is, wild symbols 1321-1327 have been added to the reels by the animation.

Example 6

Figure 14A:
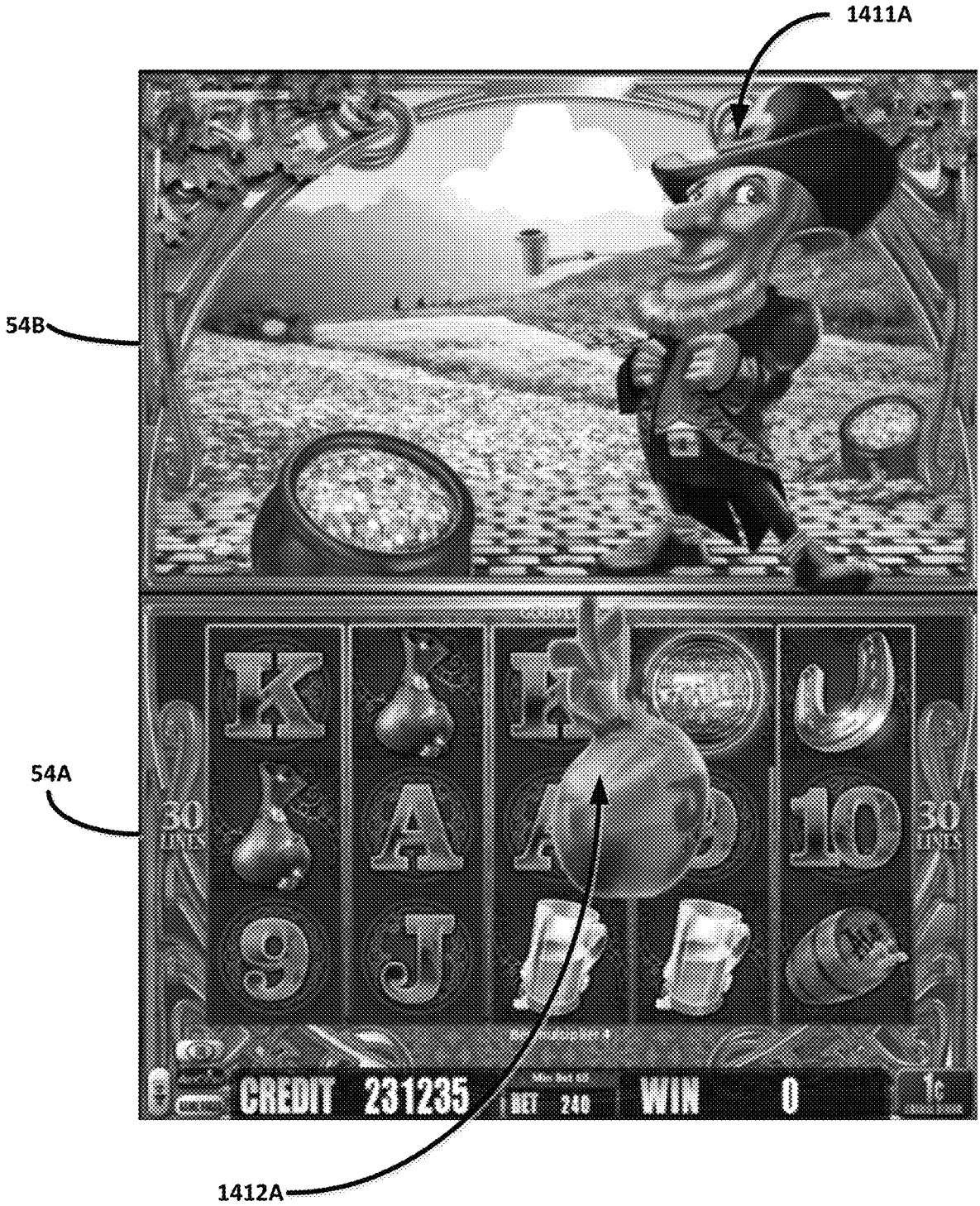
FIGS. 14A to 14C illustrate an example of awarding a large number of wild symbols.
Figure 14B:
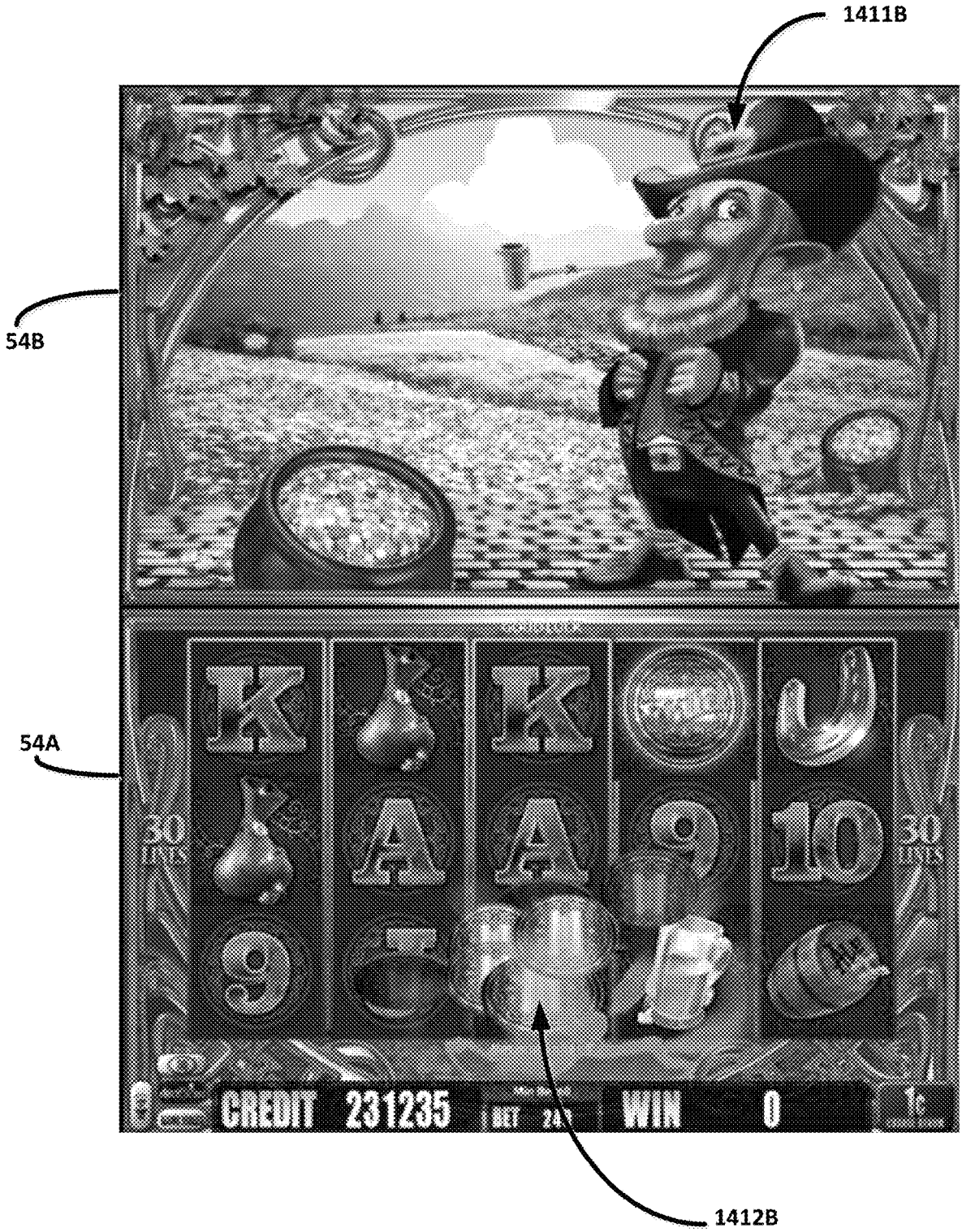
Figure 14C:
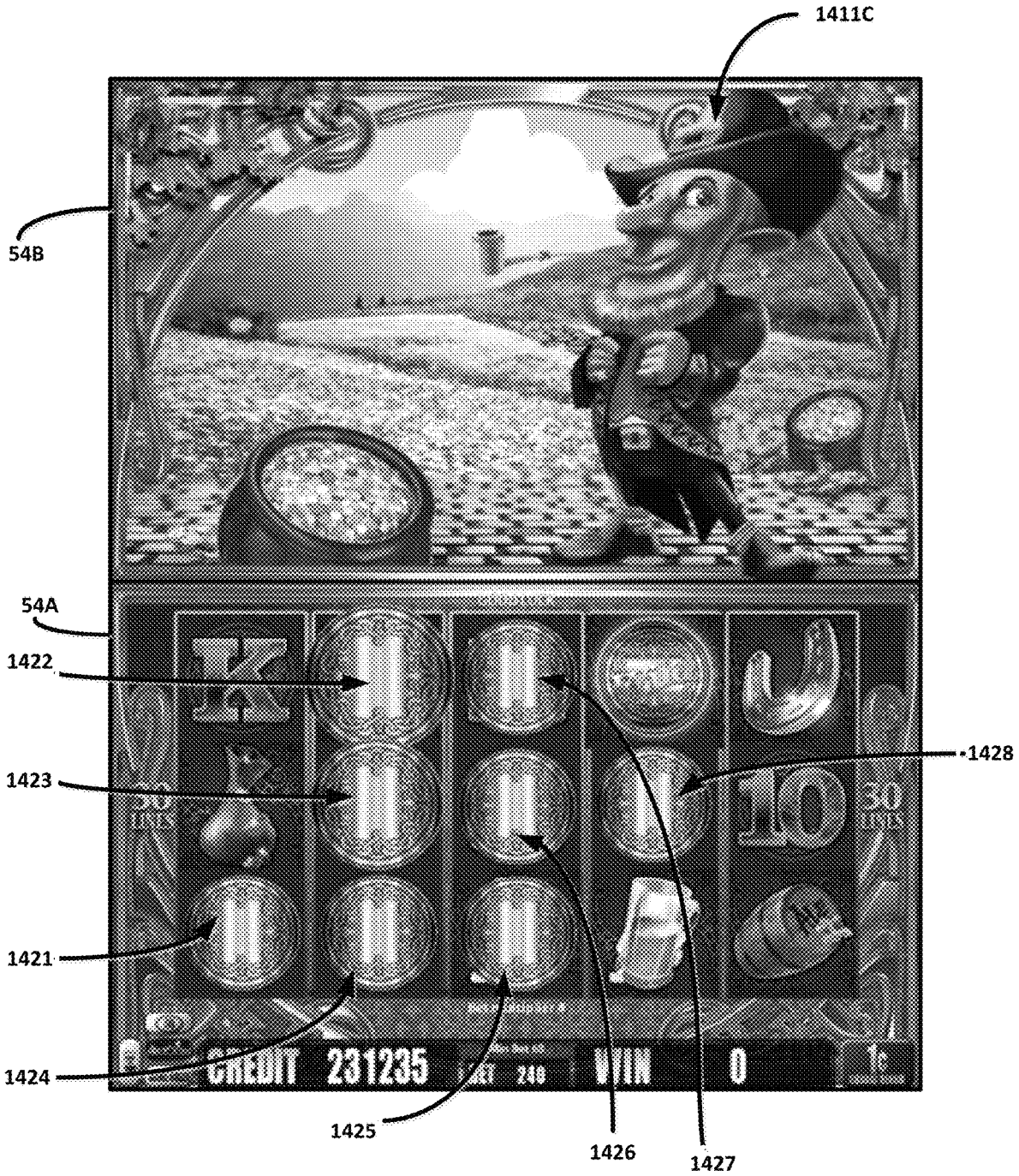

FIG. 14 shows an example of an alternative animation for adding a large number of symbols to the symbol display. In this example, a bag of gold 1412A is thrown by the leprechaun from the top display 54V to the bottom display where it is displayed in FIG. 14A. The bag of gold 1412B is shown as bursting in FIG. 14B resulting in the addition of eight wilds 1421-1428 in FIG. 14B to form the game outcome which will be evaluated.

Example 7

Figure 15:
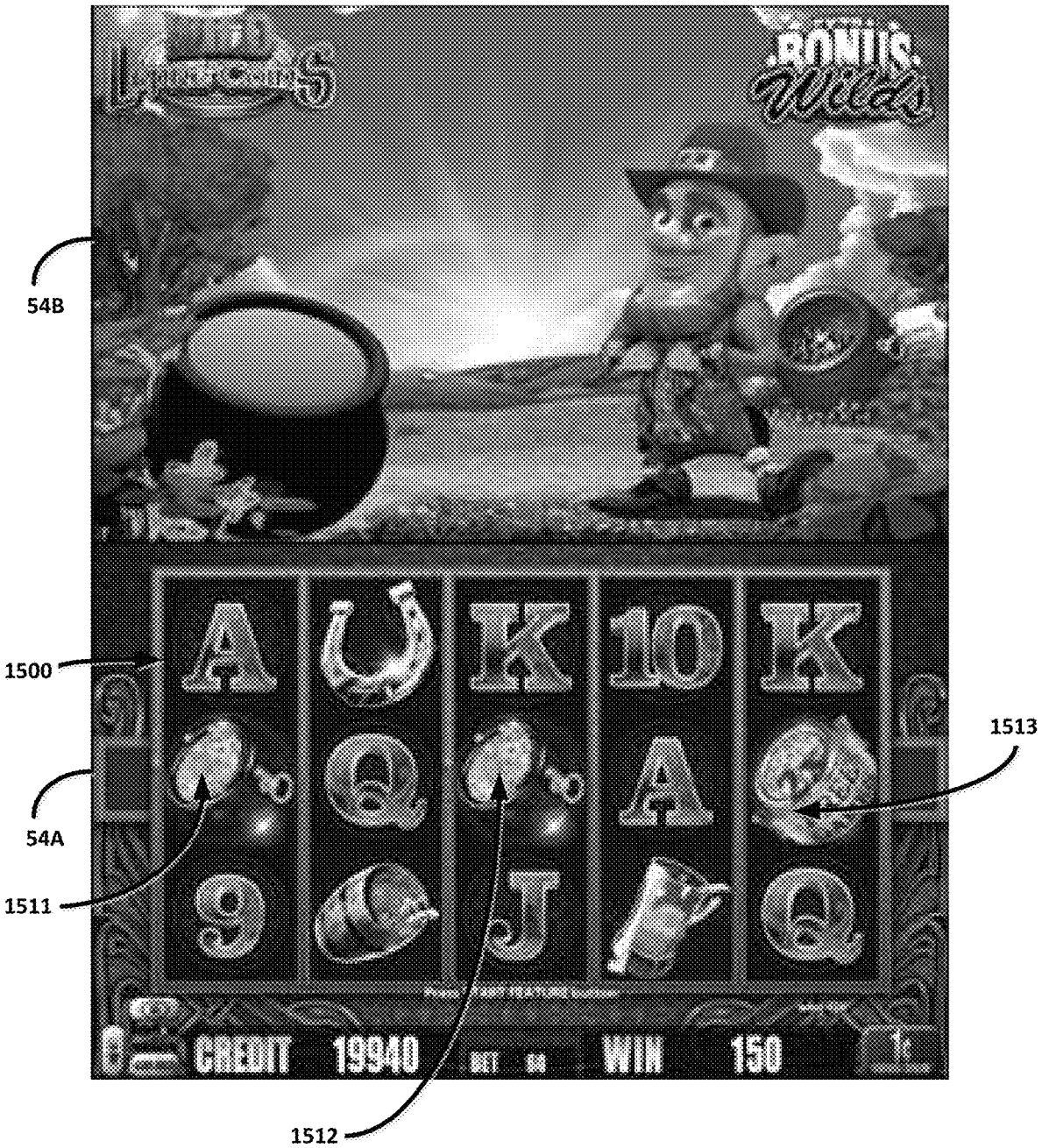
FIG. 15 illustrates an example of a multiplying trigger symbol.

FIG. 15 shows an example of a symbol display including three scatter symbols 1511, 1512 and 1513. It will be appreciated from FIG. 15 that scatter symbol 1513 includes the text "Two X free games" superimposed on scatter symbols. Accordingly, twice as many free games will be awarded because symbol 1513 is associated with a two times multiplier.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

For example, in some embodiments, an eligibility criterion may be applied for the player to be eligible for the extra wilds feature, for example that the player has made a certain sized wager, made an ante bet, selected all win lines, played sufficient games, or the player is a member of a loyalty program.

In the above embodiment, a series of free games or free spins is awarded. In some embodiments, there may be other types of game rounds awarded such as re-spins where some reels are held while other reels are re-spun. A game round involves at least one of the reels being "spun"—e.g. new symbols of the reels are selected for display at the display positions and the reel is either physically or virtually spun to a stop. Persons skilled in the art will appreciate that there may be more than one game round in a play of a gaming machine such as is the case when a series of free spins is awarded. The outcome of a game round may be no win, a win (for example from a winning combination of symbols), a contribution towards a win accrued over a plurality of game rounds, a trigger condition occurring etc. Typically, a win will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine, comprising:
- a first video display;
- a second video display;
- a random number generator;
- a game controller; and
- a memory which stores instructions, wherein execution of the instructions by the game controller, cause the game controller to at least:
  - select a plurality of symbols from a symbol set;
  - display the plurality of symbols at a plurality of symbol display positions of the first video display;
  - make a determination as to whether to add at least one extra wild symbol to at least one of a plurality of symbol display positions of the first video display, wherein the determination is randomly made, based on the random number generator, without regard to the plurality of symbols selected from the symbol set;
  - in response to the determination being that no extra wild symbols are to be added to the plurality of symbol display positions evaluate the plurality of symbols to determine an award value; and
  - in response to the determination being to add at least one extra wild symbol to at least one of the plurality of symbol display positions:
    - randomly select, based, at least in part, on a value generated by the random number generator, a symbol display position from among all display positions of the plurality of symbol display positions as a wild symbol position;
    - control the second video display to display a first portion of a wild symbol awarding animation, during which an animated object is displayed moving on the second video display;
    - control the first video display and the second video display to display a second portion of the wild symbol awarding animation, during which the animated object, shown in the first portion of the wild symbol awarding animation, moves from the second video display to the first video display, moves to the wild symbol position, and displays a wild symbol at the wild symbol position; and
    - evaluate the plurality of symbols including the wild symbol at the wild symbol position to determine the award value.

2. The gaming machine as claimed in claim 1, wherein the second video display is positioned above the first video display.

3. The gaming machine as claimed in claim 1, wherein execution of the instructions further causes the game controller to:
- select a quantity of extra wild symbols to add to the plurality of symbol display positions of the first video display; and
- control the second video display to present a quantity of animated objects during the first portion of the wild symbol awarding animation, wherein the quantity of animated objects indicates the quantity of extra wild symbols to be added to the plurality of symbol display positions.

4. The gaming machine as claimed in claim 1, wherein execution of the instructions further causes the game controller to:

select a multiple wild symbol as the wild symbol added to the wild symbol position; and control the first video display to place the multiple wild symbol at the wild symbol position, divide the multiple wild symbol placed at the wild symbol position into a plurality of single wild symbols, add one single wild symbol of the plurality of single wild symbols to the wild symbol position, and add at least one other single wild symbol of the plurality of single wild symbols to another symbol display position of the plurality of symbol display positions.

5. The gaming machine as claimed in claim 4, wherein the animated object associated with the multiple wild symbol is visually distinct from another animated object associated with the single wild symbol.

6. The gaming machine as claimed in claim 1, wherein execution of the instructions, further causes the game controller to make the determination to add at least one extra wild symbol to at least one of the plurality of symbol display positions if a random value produced by the random number generator corresponds to a defined sub-range of a range of possible random values generated by the random number generator.

7. The gaming machine as claimed in claim 1, wherein:

the plurality of symbol display positions comprises a plurality of columns;

each column of the plurality of columns represents a reel of a plurality of reels; and execution of the instructions further causes the game controller to control the first video display to display the plurality of symbols on a plurality of reels spinning through the plurality of symbol display positions.

8. The gaming machine as claimed in claim 1, wherein:

the plurality of symbol display positions are arranged in a matrix comprising a plurality of rows and a plurality of columns of symbol display positions; and the instructions further cause the game controller to, at least, randomly select the wild symbol position from among all of the symbol display positions in the matrix that are not occupied by the wild symbol.

9. The gaming machine as claimed in claim 1, wherein execution of the instructions further causes the game controller to randomly select, based on another random value produced by the random number generator, the wild symbol from a set of wild symbols including a single wild symbol and a multiple wild symbol.

10. The gaming machine as claimed in claim 1, wherein execution of the instructions further causes the game controller to select the plurality of symbols and displays the wild symbol at the wild symbol position after receiving a wager.

11. A gaming machine, comprising:

a gaming cabinet configured to house components associated with the gaming machine;

a credit input mechanism coupled to the gaming cabinet and configured to receive a physical item associated with a monetary value for establishing a credit balance, the credit balance being increasable and decreasable based on wagering activity;

a wagering input mechanism;

a payout mechanism coupled to the gaming cabinet and configured to make a payout from the credit balance;

a first video display coupled to the gaming cabinet;

a second video display coupled to the gaming cabinet;

a game controller within the gaming cabinet;

a random number generator within the gaming cabinet; and a memory within the gaming cabinet which stores instructions, wherein execution of the instructions causes the game controller to at least:

initiate a casino wagering game in response to receiving a wager input from the wagering input mechanism, the wager input indicative of a wager amount that is deducted from the credit balance;

display a plurality of reels via the first video display, the plurality of reels providing a matrix of symbol display positions on the first video display;

spin the plurality of reels to present, based on a value generated by the random number generator, a plurality of symbols from a symbol set in respective ones of the symbol display positions of the matrix of symbol display positions;

make a determination as to whether to add at least one extra wild symbol to the matrix of symbol display positions, wherein the determination is randomly made, based on the random number generator, without regard to the plurality of symbols presented from the symbol set;

in response to the determination being to add at least one extra wild symbol to the matrix of symbol display positions:

control the second video display to display a first portion of a wild symbol awarding animation, during which an animated object is displayed moving on the second video display;

control the first video display and the second video display to display a second portion of the wild symbol awarding animation during which the animated object, shown in the first portion of the wild symbol awarding animation, moves from the second video display to a selected symbol display position in the matrix of symbol display positions, and display a wild symbol at the selected symbol display position;

evaluate the plurality of symbols including the wild symbol displayed in the matrix of symbol display positions to determine an award value; and update the credit balance with the award value; and in response to the determination being to add no extra wild symbols to the matrix of symbol display positions:

evaluate the plurality of symbols displayed in the matrix of symbol display positions to determine the award value; and update the credit balance with the award value.

12. The gaming machine as claimed in claim 11, wherein execution of the instructions further causes the game controller to:

select a quantity of extra wild symbols to add to the matrix of symbol display positions; and control the second video display to present a quantity of animated objects during the first portion of the wild symbol awarding animation, wherein the quantity of animated object indicates the quantity of extra wild symbols to be added to the matrix of symbol display positions.

13. The gaming machine as claimed in claim 11, wherein execution of the instructions further causes the game controller to:

select a multiple wild symbol as the wild symbol added to the selected symbol display position; and control the first video display to place the multiple wild symbol at the selected symbol display position, divide the multiple wild symbol placed at the selected symbol display position into a plurality of single wild symbols, add one single wild symbol of the plurality of single wild symbols to the selected symbol display position, and add at least one other single wild symbol of the plurality of single wild symbols to another symbol display position in the matrix of symbol display positions.

14. The gaming machine as claimed in claim 13, wherein the animated object associated with the multiple wild symbol is visually distinct from another animated object associated with the single wild symbol.

15. The gaming machine as claimed in claim 11, wherein execution of the instructions further causes the game controller to make the determination to add at least one extra wild symbol to the matrix of symbol display positions if a random value produced by the random number generator corresponds to a defined sub-range of a range of possible random values generated by the random number generator.

16. The gaming machine as claimed in claim 11, wherein execution of the instructions further causes the game controller to randomly select the selected symbol display position from among all of the symbol display positions in the matrix that are not occupied by the wild symbol.

17. The gaming machine as claimed in claim 11, wherein execution of the instructions further causes the game controller to randomly select, based on another random value produced by the random number generator, the wild symbol from a set of wild symbols including a single wild symbol and a multiple wild symbol.

18. The gaming machine as claimed in claim 11, wherein execution of the instructions further causes the game controller to spin the plurality of reels and make the determination after receiving the wager input indicative of the wager amount.

19. A method of operating a gaming machine, the method comprising:

initiating a series of games, by a game controller of the gaming machine, in response to input received via a player interface of the gaming machine;

for each game in the series of games:

determining whether to add at least one extra wild symbol to at least one display position of a first video display of the gaming machine, wherein determining is randomly made, based on a random number generator of the gaming machine, without regard to symbols selected from a symbol set;

after determining to add at least one extra wild symbol to at least one display position of the first video display:

selecting, by the game controller based on a value generated by a random number generator of the gaming machine, a first plurality of symbols from the symbol set; displaying the first plurality of symbols in a matrix of symbol display positions on the first video display of the gaming machine;

randomly selecting, based, at least in part, on the random number generator, a symbol display position from among all display positions of the matrix of symbol display positions as a wild symbol position;

controlling, by the game controller, a second video display of the gaming machine to display a first portion of a wild symbol awarding animation, during which an animated object is displayed moving on the second video display;

controlling, by the game controller, the first video display and the second video display to display a second portion of the wild symbol awarding animation during which the animated object, shown in the first portion of the wild symbol awarding animation, moves from the second video display to the wild symbol position in the matrix of symbol display positions, and display a wild symbol at the wild symbol position;

evaluating, by the game controller, the first plurality of symbols including the wild symbol at the wild symbol position to determine an award value; and updating a credit balance with the award value; and after determining to add no extra wild symbols to the first video display:

selecting, by the game controller based on another value generated by the random number generator of the gaming machine, a second plurality of symbols from the symbol set;

displaying the second plurality of symbols in the matrix of symbol display positions on the first video display;

evaluating, by the game controller, the second plurality of symbols to determine the award value; and updating the credit balance with the award value.

20. The method as claimed in claim 19, further comprising:

selecting, with the game controller, a quantity of extra wild symbols to add to the plurality of symbol display positions of the first video display; and controlling, with the game controller, the second video display to present a quantity of animated objects during the first portion of the wild symbol awarding animation, wherein the quantity of animated objects indicates the quantity of extra wild symbols to be added to the matrix of symbol display positions.

21. The method as claimed in claim 19, further comprising:

selecting, with the game controller, a multiple wild symbol as the wild symbol added to the wild symbol position; and controlling, with the game controller, the first video display to place the multiple wild symbol at the wild symbol position, divide the multiple wild symbol placed at the wild symbol position into a plurality of single wild symbols, add one single wild symbol of the plurality of single wild symbols to the wild symbol position, and add at least one other single wild symbol of the plurality of single wild symbols to another symbol display position in the matrix of symbol display positions.

22. The method as claimed in claim 21, wherein the animated object associated with the multiple wild symbol is visually distinct from another animated object associated with the single wild symbol.

23. The method as claimed in claim 19, further comprising determining to add at least one extra wild symbol to the first video display if a random value produced by the random number generator corresponds to a defined sub-range of a range of possible random values generated by the random number generator.

24. The method as claimed in claim 19, wherein displaying the first plurality of symbols in the matrix of symbol display positions comprises displaying, by the game controller, the first plurality of symbols on a plurality of reels that spin through the matrix of symbol display positions.

25. The method as claimed in claim 19, wherein:

the matrix of symbol display positions comprises a plurality of rows and a plurality of columns of symbol display positions; and randomly selecting the wild symbol position from among all of the display positions in the matrix that are not occupied by the wild symbol.

26. The method as claimed in claim 19, further comprising randomly selecting, with the game controller based on another random value produced by the random number generator, the wild symbol from a set of wild symbols including a single wild symbol and a multiple wild symbol.

* * * * *